US008214073B2

(12) United States Patent
Keskinen

(10) Patent No.: US 8,214,073 B2
(45) Date of Patent: Jul. 3, 2012

(54) DESIGNING DRILLING PATTERN FOR EXCAVATING ROCK CAVERN

(75) Inventor: Martti Keskinen, Espoo (FI)

(73) Assignee: Sandvik Mining and Construction Oy, Tampere (FI)

( * ) Notice: Subject to any disclaimer, the term of this patent is extended or adjusted under 35 U.S.C. 154(b) by 460 days.

(21) Appl. No.: 12/520,347

(22) PCT Filed: Dec. 20, 2007

(86) PCT No.: PCT/FI2007/050715

§ 371 (c)(1),
(2), (4) Date: Jun. 19, 2009

(87) PCT Pub. No.: WO2008/078002

PCT Pub. Date: Jul. 3, 2008

(65) Prior Publication Data

US 2010/0044107 A1 Feb. 25, 2010

(30) Foreign Application Priority Data

Dec. 22, 2006 (FI) ..... 20065851
Dec. 22, 2006 (FI) ..... 20065854
Feb. 19, 2007 (FI) ..... 20075118

(51) Int. Cl.
*G06F 19/00* (2011.01)
*E21B 44/00* (2006.01)

(52) U.S. Cl. ..... 700/182; 700/83; 175/24

(58) Field of Classification Search ..... 700/182, 700/83, 90; 175/24, 26; 703/2, 6; 702/9; 102/311, 312

See application file for complete search history.

(56) References Cited

U.S. PATENT DOCUMENTS 4,639,868 A * 1/1987 Tanaka et al. ..... 702/9
4,698,570 A 10/1987 Satoh
6,293,355 B1 9/2001 Koivunen et al.
2010/0078215 A1* 4/2010 Saleniemi et al. ..... 175/24

FOREIGN PATENT DOCUMENTS

DE 44 45 420 C1 11/1995
FI 105942 10/2000
JP 11-081855 3/1999
WO 03/025341 3/2003

OTHER PUBLICATIONS

Finland Search Report dated Nov. 29, 2007 issued in Finland Application No. 20065484.
Finland Search Report dated Jan. 30, 2008 issued in Finland Application No. 20075118.
International Search Report and Written Opinion mailed Apr. 29, 2008 issued in PCT Application No. PCT/FI2007/050710.

* cited by examiner

*Primary Examiner* — Albert Decady
*Assistant Examiner* — Steven Garland
(74) *Attorney, Agent, or Firm* — Morgan, Lewis & Bockius LLP

(57) ABSTRACT

The invention relates to a method and a software product for designing a drilling pattern for excavating a rock cavern. The invention further relates to a rock-drilling rig, in whose control unit the software product and the method are executable. During designing of the drilling pattern, drill hole bottom locations are placed at a blast plane at the bottom of a round. A drilling pattern design program determines the missing properties of the drill holes viewed from the bottom of the round towards a navigation plane. The program is able to determine a starting location for a drill hole based on the location and the direction of the bottom. The program also performs blasting calculation on the drill holes positioned.

25 Claims, 10 Drawing Sheets

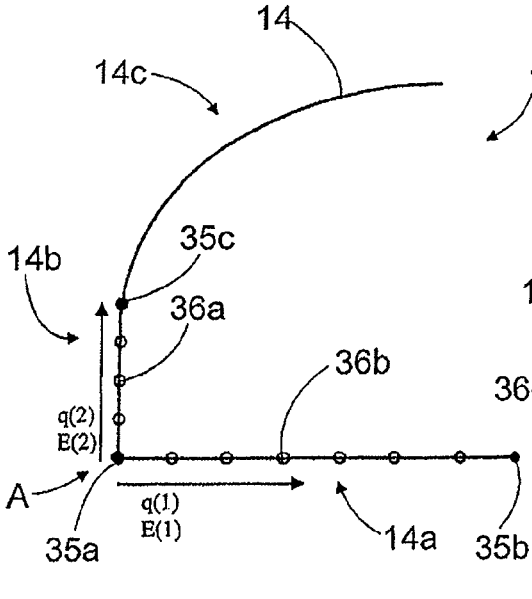

FIG. 6a

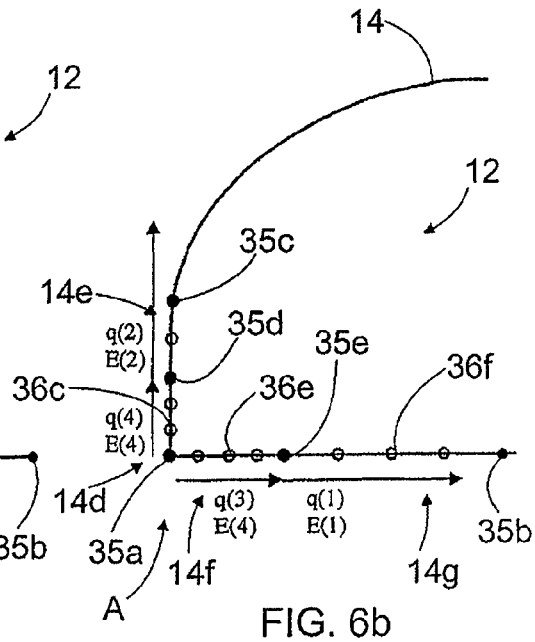

FIG. 6b

| Group of holes | Specific charge (q) | Charge ID | Holespacing (E) target | max | Target (F) E / V | Even |
|---|---|---|---|---|---|---|
| Profile | | | | | | |
| ▪ bottom | q1 | c1 | $E_t1$ | $E_m1$ | 1,25 | x |
| ▪ wall | q2 | c2 | $E_t2$ | $E_m2$ | | x |
| ▪ roof | q3 | c3 | $E_t3$ | $E_m3$ | | x |
| Aidrow 1 | | | | | | |
| ▪ bottom | q4 | c4 | $E_t4$ | $E_m4$ | | x |
| End profile | q5 | c5 | $E_t5$ | $E_m5$ | | |
| ▪ roof | q6 | c6 | $E_t6$ | $E_m6$ | | x |
| Aidrow 2 | | | | | | |
| ▪ bottom | q7 | c7 | $E_t7$ | $E_m7$ | | x |
| ▪ wall | q8 | c8 | $E_t8$ | $E_m8$ | | |
| ▪ roof | q9 | c9 | $E_t9$ | $E_m9$ | | x |

FIG. 7a

| Charge ID | Specific charge (q) | Cracking zone [m] | Bottom charge | Column charge | Total mass of charge |
|---|---|---|---|---|---|
| c4 | 0,55 | 0,8 | 0,74 | 0,55 | 1,29 |
| c7 | 0,74 | 1,1 | 0,9 | 0,74 | 1,64 |
| c10 | 1,2 | 2,4 | 0,17 | 1,2 | 1,37 |
| c11 | 0,9 | 1,5 | 1,29 | 0,9 | 2,19 |
| c12 | 0,15 | 0,3 | 0,55 | 0,08 | 0,63 |

FIG. 7b

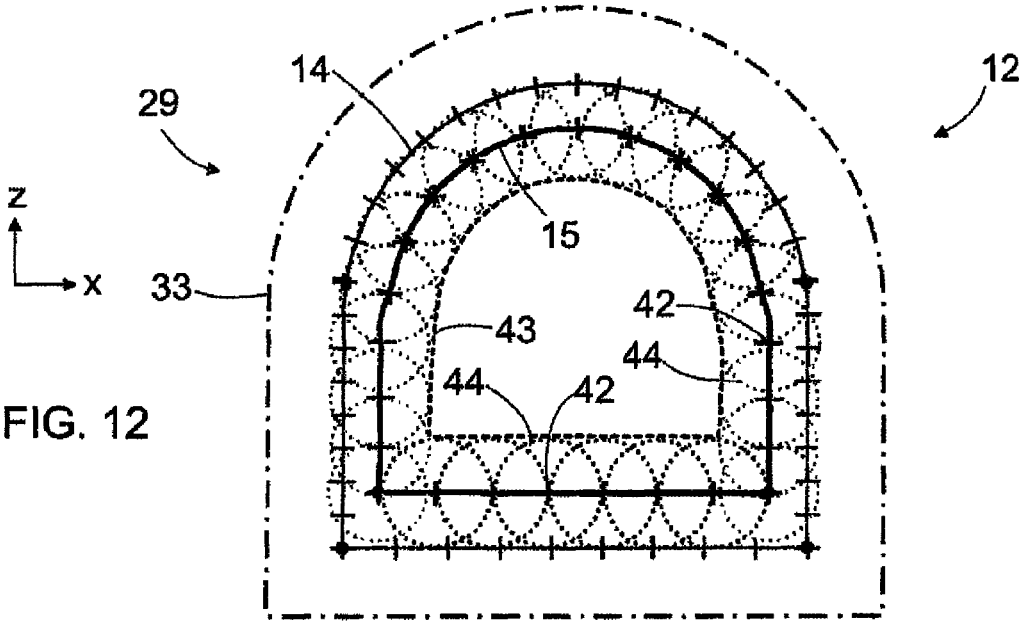
FIG. 12
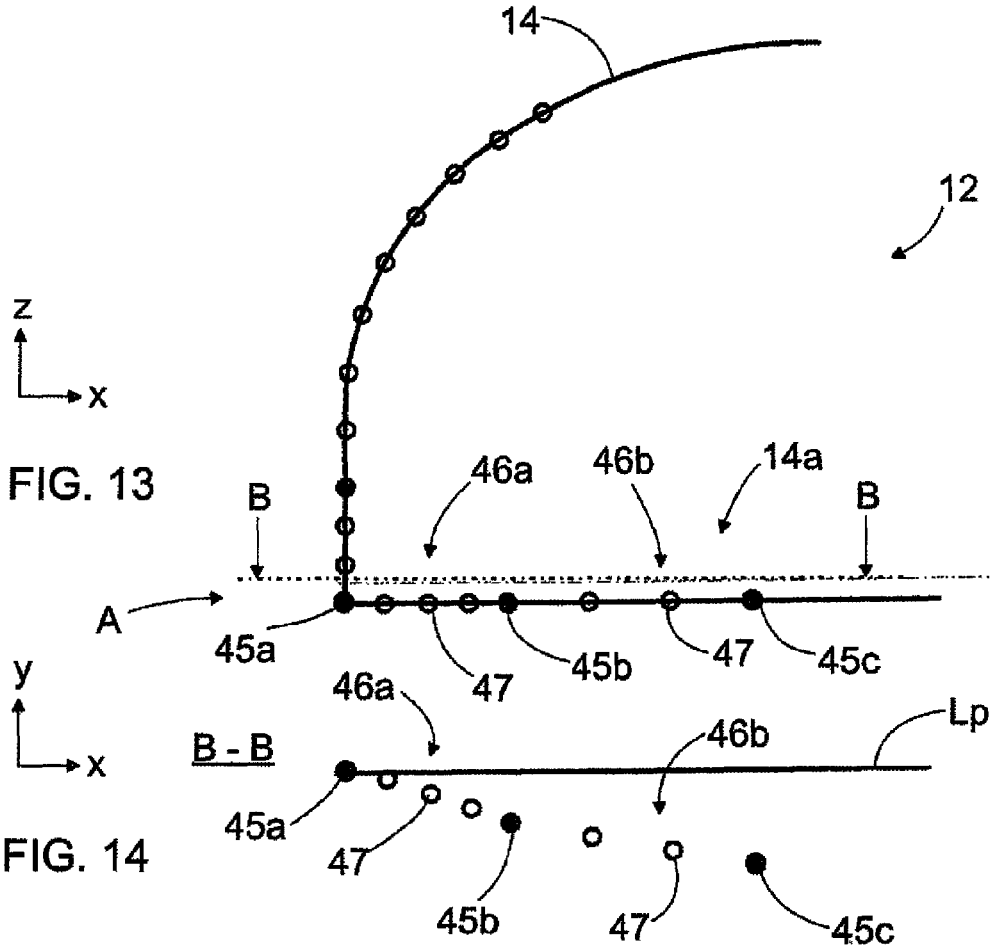
FIG. 13
FIG. 14

DESIGNING DRILLING PATTERN FOR EXCAVATING ROCK CAVERN

CROSS REFERENCE TO RELATED APPLICATIONS:

This application is the National Stage of International Application No. PCT/FI2007/050715, filed Dec. 20, 2007, and claims benefit of Finnish Application No. 20065851, filed Dec. 22, 2006, Finnish Application No. 20065854, filed Dec. 22, 2006, and Finnish Application No. 20075118, filed Feb. 19, 2007.

BACKGROUND OF THE INVENTION

The invention relates to a method of designing a drilling pattern for excavating a rock cavern. A drilling pattern determines at least the locations and hole direction angles of drill holes in the coordinate system of the drilling pattern and the lengths of the drill holes for a round to be drilled at a tunnel face. In the method, a designer designs the drilling pattern with the aid of a drilling pattern design program. The object of the invention is described in more detail in the preamble of the first independent claim.

The invention also relates to a software product as claimed in the second independent claim, the execution of the software product in an designing computer generating actions required for designing the drilling pattern. Furthermore, the invention relates to a rock-drilling rig as claimed in the preamble of the third independent claim, the software product being executable in a control unit of the rock-drilling rig for achieving the actions required for designing the drilling pattern.

Tunnels, underground storage halls and other rock caverns are excavated in rounds. Drill holes are drilled at the tunnel face, and they are charged and blasted after the drilling. During one blast, an amount of rock material equal to the round is detached from the rock. A plan is drawn up in advance for excavating the rock cavern, and information is determined about rock types, among other things. Generally, the orderer of the rock cavern also sets various quality requirements on the cavern to be excavated. For each round, a drilling pattern is further designed as office work and delivered to the rock-drilling rig for drilling drill holes in the rock so as to generate the desired round.

Drilling pattern design programs that aid a designer in designing a pattern have been developed for designing the drilling pattern. Thus, the designing of a drilling pattern is an interactive operation between the designer and the drilling pattern design program. In present computer-aided drilling pattern design programs, the drilling pattern is designed at the navigation plane, i.e. the situation is examined from the point of view of the operator of the rock-drilling rig. Furthermore, rock blasting and rock detachment are three-dimensional events that are difficult to examine from the navigation plane. In addition, drilling patterns designed at the navigation plane have been found to contain significant inaccuracies particularly at the corners of the pattern, which results from the look-out angles of the profile holes of the pattern. Consequently, the problem in drilling patterns designed at the navigation plane is in that they do not achieve a sufficiently good accuracy in the blasting of a round.

BRIEF DESCRIPTION OF THE INVENTION

The object of the present invention is to provide a novel and improved method and software product for designing a drilling pattern. It is a further object to provide a novel and improved rock-drilling rig enabling the computer-aided designing of a drilling pattern in the control unit thereof.

The invention is characterized by determining, in the drilling pattern, a blast plane located at the bottom of the round at a distance corresponding to the length of the pattern from the navigation plane; placing drill hole bottom locations at the bottom of the round at the blast plane; performing blasting calculation at the blast plane for at least some holes in the drilling pattern; utilizing blasting-technical data stored in advance in a memory for the blasting calculation; and supplying one of the following drill hole properties to the drilling pattern design program. drill hole start location at navigation plane, drill hole direction, and determining a missing second drill hole property on the basis of the location of the drill hole bottom and the first, given property, the properties of the drill hole being determined viewed from the bottom of the round towards the navigation plane. The characterizing features of the invention are determined in more detail in the characterizing part of each independent claim.

An idea of the invention is that the basis for the planning of a drilling pattern is an examination of the drill holes at the bottom of a round. Then, a blast plane is determined in the drilling pattern, the plane being located at the bottom of the round, at a distance corresponding to the length of the pattern from the navigation plane. The drill hole bottom locations may be placed at the bottom of the round at the blast plane, allowing blasting calculation to be performed for at least some holes of the drilling pattern on the blast plane. Blasting-technical data stored in advance in a memory are utilized in the blasting calculation.

An advantage of the invention is that the planning of the drilling pattern is more illustrative than previously, since the space to be generated is being planned instead of concentrating on the determination of the starting locations of the drill holes, as in conventional planning manners. Furthermore, thanks to a blasting-technical examination, the locations of the bottoms of the holes to be drilled may be determined according to the requirements of the blasting. This being so, the drill holes are in the correct location at the bottom of the round as regards the blasting, and, on the other hand, the drilling of extra holes is avoided. In addition, rock can be made to detach efficiently during blasting. Furthermore, when rock is caused to be detached in the planned manner during blasting, the quality of the rock cavern to be generated may be better. The planning carried out at the bottom of the round, together with the blasting-technical examination, also facilitates the determination of the charging. The determination of the specific charge for the different sections of the drilling pattern is easier and more illustrative to perform at the bottom of a round than at the navigation plane. Typically, the specific charge cannot be determined correctly in all sections of the drilling pattern until after up to 10 to 20 blasts, after the analysis of each blast result and the iteration of the blasting values. Now, when planning is carried out at the bottom of the round and the blasting-technical examination is taken into consideration therein from the beginning, the values of the specific charge can be determined correctly after only a few rounds.

The idea of an embodiment is that blasting-technical parameters may be stored as a specific charge file or as a corresponding data element, from where they may be loaded when required for the use of the drilling pattern design program. On the other hand, the designer may manually input parameters for blasting calculation by means of a keyboard, for example.

The idea of an embodiment is to utilize interdependence rules between burden, hole spacing, specific charge and degree of charge, stored in advance in a memory, and blasting-technical data concerning the specific charge and the degree of charge, stored in advance in a memory.

The idea of an embodiment is to utilize predetermined specific charge values q, hole spacing E and an average degree of charge I in accordance with formula V=I/(q*E), wherein V is the burden, in the blasting-technical calculation.

The idea of an embodiment is to predetermine specific charge values for the holes of the different parts of the drilling pattern. In addition, the charges to be used in the different parts of the pattern may be tabulated in advance.

The idea of an embodiment is to determine cracking zones at least for the drill holes of the end profile on the basis of the charge data of each drill hole. The cracking zones of the drill holes in the end profile are then compared with a predetermined, allowed cracking zone at least at the bottom of the round, and an indication is given to the user if the cracking zone of even one single drill hole is greater than the allowed cracking zone. On the other hand, the cracking zones may be displayed on the display of the designing computer in a manner allowing the designer to actively take the cracking zones into consideration during the planning. Thus, the designer is able to immediately modify the parameters of the drilling pattern so as to manage cracking. The cracking zones may be displayed on the display at the same time as the drilling pattern is being designed. If need be, the examination of the cracking zones may be carried out not only for the end profile, but also at least for the drill holes of the outermost aid row. Let it be mentioned that the end profile is a line passing through the drill hole bottoms of the outermost group of holes, and the aid rows, in turn, are groups of holes located inside the end profile, which also comprise a plurality of drill holes. On the basis of the examination of the cracking zones, the designer is able to modify the drilling pattern designed in a manner eliminating any exceeding of the allowed cracking zone. The quality requirements set in advance by the orderer of the rock cavern may thus be taken into consideration in the planning of each round.

The idea of an embodiment is to display the profile of a pre-determined, allowed cracking zone between the navigation plane and the blast plane in a graphic user interface. Furthermore, the cracking zone of each drill hole is displayed in the graphic user interface as a cracking circle formed around the bottoms and starting locations of the drill holes in the end profile. The size of the diameter of the cracking circle is proportional to the size of the cracking zone. Between the cracking circle of the bottom and the cracking circle of the starting location of each drill hole, a cylindrical cracking space is formed, which may be displayed on the display of the designing computer, allowing the designer to pay attention to the cracking during planning. Furthermore, an indication may be given to the user should even one single cylindrical cracking space intercept the profile of the allowed cracking zone between the navigation plane and the blast plane. The cracking circles and the cracking spaces to be displayed visually in the user interface illustratively show to the designer whether the drilling pattern corresponds to the requirements set as regards the cracking zones.

The idea of an embodiment is to determine a plurality of locations for the drill hole bottoms for the end profile at the blast plane at a distance equal to the size of the desired hole intervals E from each other and to then determine burdens V for these drill holes. For calculating the burdens V, a blasting-technical calculation is performed for the drill holes at the blast plane. Furthermore, a burden line is determined at the ends of the burdens determined for the drill holes of the end profile inside the end profile. The outermost aid row is placed on the burden line of the end profile. A plurality of drill hole bottom locations is then determined on the outermost aid row at the blast plane at a distance from each other equal to the size of the desired hole intervals. The end profile, the burden line and the drill hole bottom locations may be presented visually in a graphic user interface. Blasting-technical planning enables a more accurate determination of the burden and, consequently, the number of holes to be drilled may be decreased in some cases as compared with a drilling pattern designed in a conventional manner. The drilling time naturally shortens, since no extra holes are drilled.

The idea of an embodiment is to calculate the burdens V in the blasting-technical calculation by formula V=I/(q*E), wherein q is specific charge value, E is hole interval, and I is average degree of charge. These blasting-technical parameters may be predetermined e.g. as a file, a table or a corresponding data element, from where they may be loaded for use by the drilling pattern design program.

The idea of an embodiment is to generate a circle of burden for each drill hole of the end profile around the drill hole bottom. The circle of burden is generated in such a manner that the size of its radius is proportional to the size of the burden. Furthermore, a burden line touching the circumference of each circle of burden at one point in its inner edge may be generated. Accordingly, the burden line is an envelope composed of tangents drawn at the inner point of each circle of burden. The circles of burden and the burden line may be presented visually in a user interface. Thereafter, a plurality of drill hole bottom locations may be determined on the outermost aid row at the blast plane, the locations having the desired hole interval between them. The locations of the drill hole bottoms of the aid row may also be displayed in the graphic user interface.

The idea of an embodiment is to determine the burden line for the drill holes on the outermost aid row on the basis of the blasting-technical calculation performed at the blast plane. In this case, a second aid row is generated inside the outermost, i.e. the first aid row, and a plurality of drill hole bottom locations is determined at the blast plane at a distance from each other equal to the desired hole intervals. In a corresponding manner, the burden lines of any following aid rows may be determined, and the inner aid rows may be adapted onto the determined burden lines. It is further feasible to utilize blasting-technical burden calculation for determining the locations of the field drill holes in the drilling pattern on a section between the cut and the innermost aid row.

The idea of an embodiment is to take account of the blasting calculation when placing the drill hole bottom locations onto the bottom of the round.

The idea of an embodiment is to determine ratio F, which is the quotient of hole spacing E and burden V, i.e. F=E/V, in at least one data element for the placement of the drill hole bottom locations. Ratio F may be determined separately for each group of holes. Furthermore, a calculatory hole spacing E is determined by formula $E=\sqrt{[(I*F)/q]}$, wherein q is specific charge value and I is average degree of charge. Thereafter, the desired section from the drilling pattern is determined, onto which the drill hole bottom locations are to be placed. The length of the selected section is divided by the calculatory hole spacing E, yielding the accurate number of drill hole bottoms to be placed onto the section, typically a decimal number. The designer or the drilling pattern design program then selects the nearest integer as the number of drill hole bottoms to be placed onto the selected section, after which the program calculates a new hole spacing E1 in such a manner that the drill hole bottom locations are equidistant in the selected section. Finally, the burden may further be calculated by formula V=E1/F. Ratio F may be determined empirically for the different groups of holes.

The idea of an embodiment is to place the drill hole bottom locations manually in at least one group of holes.

The idea of an embodiment is to predetermine the hole spacing between the drill hole bottoms in a group of holes. Thereafter, the drill hole bottom locations are placed automatically in the group of holes by means of the drilling pattern design program, taking account of the determined hole spacing. Alternatively, the desired section of a group of holes may be manually marked off and drill hole bottom locations may be automatically placed onto said marked-off section by means of the drilling pattern design program in accordance with the predetermined hole spacing. Still another alternative is to manually determine some desired part of a group of holes and to manually determine the number of drill holes in said section of the group of holes. Then the drilling pattern design program is allowed to automatically place the drill hole bottom locations at equal distances onto the selected section of the group of holes. Automatic functions in the drilling pattern design program for positioning drill hole bottoms into a group of holes substantially facilitate and speed up the designer's work. The designer may assign routine tasks to the drilling pattern design program for execution. On the other hand, later editing of the drilling pattern is also easy and fast.

The idea of an embodiment is to input the direction of the drill hole in the drilling pattern design program. The program then determines the starting location of the drill hole at the navigation plane on the basis of the location of the drill hole bottom and the direction of the drill hole.

The idea of an embodiment is to input the starting location of the drill hole at the navigation plane in the drilling pattern design program. The drilling pattern design program then calculates the direction of the drill hole on the basis of the bottom and the given starting location of the drill hole.

The idea of an embodiment is that the designer determines at least one alignment point at the front of the navigation plane. In addition, the designer selects a drill hole, whose starting location is determined on the basis of the alignment point and the location of the bottom of the hole. The drilling pattern design program then determines a straight line passing through the bottom of the selected drill hole and the alignment point, and defines the intersection of said straight line and the navigation plane as the starting location of the drill hole. The drilling pattern design program is then able to calculate the directions of the drill holes on the basis of the drill hole bottom and the starting location determined by means of the alignment point.

The idea of an embodiment is to determine at least one master hole in at least one group of holes of the drilling pattern. One or more dominating properties are determined for the master hole, and at least one property of at least one second drill hole is determined on the basis of the dominating properties of the master hole. The group of holes may be e.g. an end profile, an aid row or a field hole element. A further idea is to use master holes in the drilling pattern that can be edited versatilely afterwards. In this case, master holes may be easily added and removed later, and their locations and other properties may be altered.

The idea of an embodiment is that the designer determines at least two master holes in at least one group of holes of the drilling pattern, between which is arranged one or more intermediate holes. Furthermore, the designer determines one or more dominating properties for the master holes, for instance one of the following. location in the group of holes, depth, hole direction angle, degree of charge, hole spacing. In this case, the drilling pattern design program is able to calculate one or more properties of the intermediate hole on the basis of the dominating properties of the master holes. The group of holes may be an end profile, an aid row or a field hole element. An advantage of the use of master holes is that they significantly speed up the designing of the drilling pattern. Furthermore, the use of master holes facilitates later modification of the drilling pattern, since the designer is able to conveniently change the values of the master holes, whereby the drilling pattern design program again calculates new values for the intermediate holes. In addition, the designer is able to modify the drilling pattern by removing and adding master holes.

BRIEF DESCRIPTION OF THE FIGURES

Some embodiments of the invention will be described in more detail in the accompanying drawings, in which FIG. 1 schematically shows a side view of a rock-drilling rig and means for designing a drilling pattern, FIG. 2 schematically shows an xz projection of a drilling pattern, FIG. 3 schematically shows an xy projection, i.e. seen from above, of the principle of a drilling pattern, FIG. 4 schematically shows an xz projection of some profiles of a drilling pattern, FIG. 5 schematically shows an xy projection of the depths of drill holes in different groups of holes of a drilling pattern, FIGS. 6*a* and 6*b* schematically show xz projections of the placement of ending points of drill holes in a group of holes, FIG. 7*a* schematically shows a specific charge table, FIG. 7*b* schematically shows a table containing data about an explosive, FIG. 8 schematically shows an xz projection of drill hole bottom locations adapted onto an end profile, and an allowed cracking zone shown around the end profile, FIG. 9 schematically shows an xz projection of a cracking zone examination for drill holes on an end profile, FIG. 10 schematically shows a perspective view of cracking circles at the blast plane and at the navigation plane, and a cylindrical cracking space formed between them, FIG. 11 schematically shows an xz projection of burden calculation for drill holes on an end profile.

FIG. 12 schematically shows an xz projection of burden calculation for drill holes on an outermost aid row, FIG. 13 schematically shows an xz projection of hole depth masters and intermediate holes adapted onto the section of corner A of a drilling pattern, FIG. 14 schematically shows the principle of the hole depth masters according to FIG. 13 seen from direction B-B, FIG. 15 schematically shows an xz projection of the effect of hole direction masters adapted onto the section of corner A of a drilling pattern, FIG. 16 schematically shows an xy projection of some details associated with the hole direction angles of drill holes, FIG. 17 schematically shows an xy projection of the determination of the hole direction angles of drill holes by means of an alignment point, FIG. 18 schematically shows an xy projection of a so-called trumpet-like transition in a rock cavern being generated, FIG. 19 schematically shows a yz projection of the modification of a drilling pattern for the desired peg number between transition points in association with a trumpet-like transition, and FIG. 20 schematically shows an xz projection of master holes, each having a predetermined area of influence.

In the figures, some embodiments of the invention are described in a simplified manner for the sake of clarity. In the figures, like parts are denoted by like reference numerals.

DETAILED DESCRIPTION OF SOME EMBODIMENTS OF THE INVENTION

Figure 1:
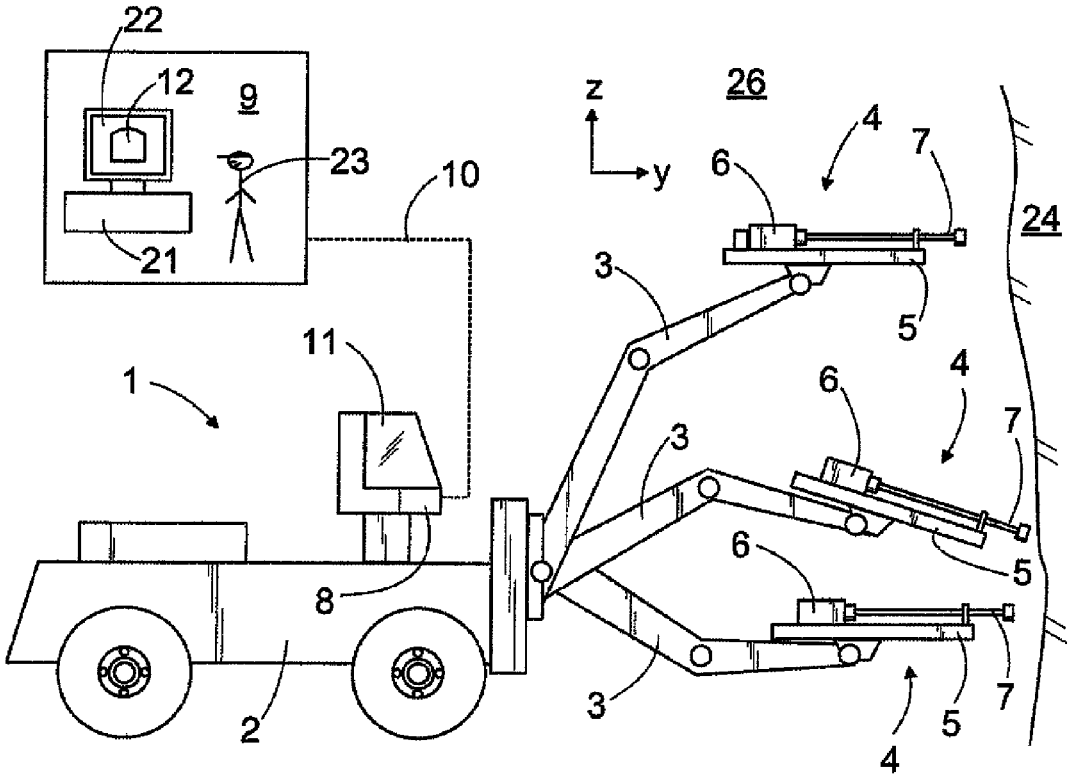

FIG. 1 shows a rock-drilling rig 1 comprising a movable carrier 2, one or more drilling booms 3 and drilling units 4 adapted to the drilling booms 3. The drilling unit 4 comprises a feeding beam 5 for moving a rock-drilling machine 6 by means of a feeding device. Furthermore, the drilling unit 4 comprises a tool 7 for transmitting impacts issued by the percussion device of the rock-drilling machine to the rock to be drilled. The rock-drilling rig 1 further comprises at least one control unit 8 adapted to control actuators belonging to the rock-drilling rig 1. The control unit 8 may be a computer or a corresponding device and it may comprise a user interface and a display device, and control means for supplying commands and data to the control unit 8.

Typically, a drilling pattern 12 is designed for the drilling of each round, the pattern determining at least the locations of the holes to be drilled and their hole direction angles in the coordinate system of the drilling pattern. The drilling pattern may be designed at a location external to the drilling site, such as at an office 9, where it may be stored in a memory means, such as in a memory stick or a diskette, for example, or it may be transferred directly by means of a data transfer link 10 to the control unit 8 of the rock-drilling rig, and stored in a memory means there, such as a hard disk or a memory diskette. Alternatively, the planning and modification of the drilling pattern 12 may take place by means of the control unit 8 in a control cabin 11 of the rock-drilling rig 1, for example. Furthermore, existing drilling patterns may be modified either at the drilling site or outside thereof. Designing the drilling pattern is computer-aided and generally iterative by nature. The drilling pattern design program is run in a designing computer 21, in the control unit 8 or the like, and a designer 23 acts interactively with the drilling pattern design program, and inputs the required information, makes selections and controls the designing process. Existing planned pattern parts may be modified iteratively during the designing to achieve a better result.

Once the drilling pattern is designed, it may be loaded in the control unit 8 of the rock-drilling rig and executed. The planned drill holes are drilled in a rock 24, charged and blast. Rock material to the extent of the desired round is detached from the rock 24 and transported away. New drill holes are then drilled for the following round by following a new drilling pattern 12.

Figure 2:
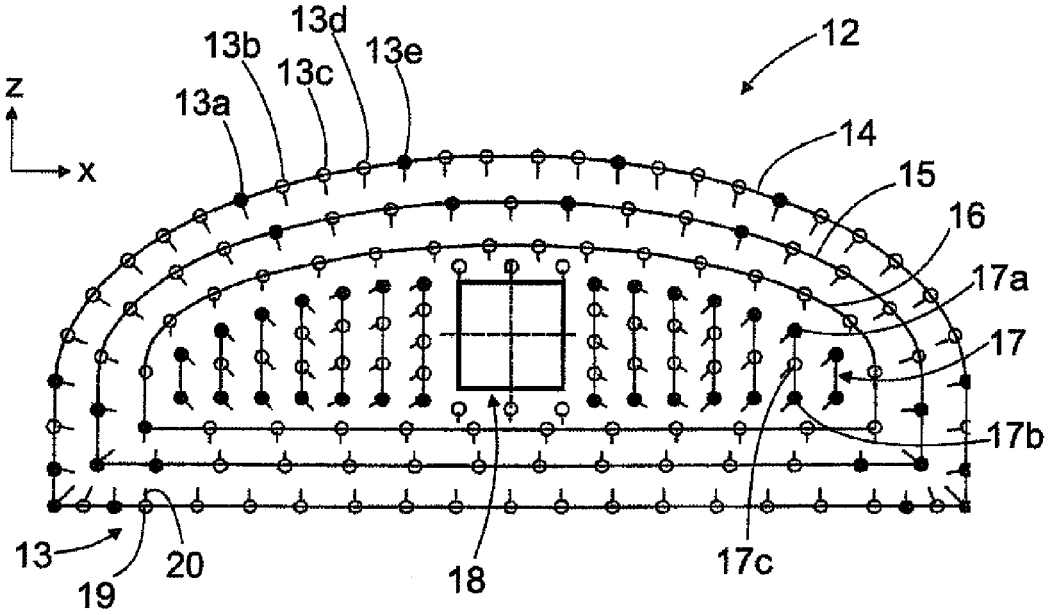

FIG. 2 shows a drilling pattern 12 that may comprise a plurality of drill holes 13*a* to 13*e* arranged on a plurality of nested rows 14 to 16. Furthermore, the drilling pattern may comprise field holes 17*a* to 17*c* placed in a section between the innermost drill hole row 16 and a cut 18. Two or more field holes 17*a* to 17*c* may constitute a field hole element 17. Also the cut 18 usually contains a plurality of drill holes. The nested drill hole rows 14 to 16 and the field hole elements may be called a group of holes. Each such group of holes may be handled as one whole in the planning and modification of the drilling pattern, or a desired part thereof may be marked off.

The outermost drill hole row is an end profile 14, the next innermost drill hole row is a first aid row 15, and the next is a second aid row 16, and so on. Accordingly, there may be one or more aid rows. In the drilling pattern 12, the drill hole 13 may be presented as a circle 19, either white or dark. Dark circles, such as the drill holes denoted by reference marks 13*a* and 13*e* in FIG. 2, may be so-called master holes and the white circles denoted by reference marks 13*b* to 13*d* between them may be so-called intermediate holes. The significance of master holes and intermediate holes will be explained later in the present application. Furthermore, the direction of each drill hole 13 may be denoted by a directional line 20 in the drilling pattern 12. An xz projection of the drilling pattern 12, like the one in FIG. 2, may be presented in a graphic user interface 22 of a designing computer 21, as well as in a graphic user interface of the control unit 8 of the rock-drilling rig 1.

Figure 3:
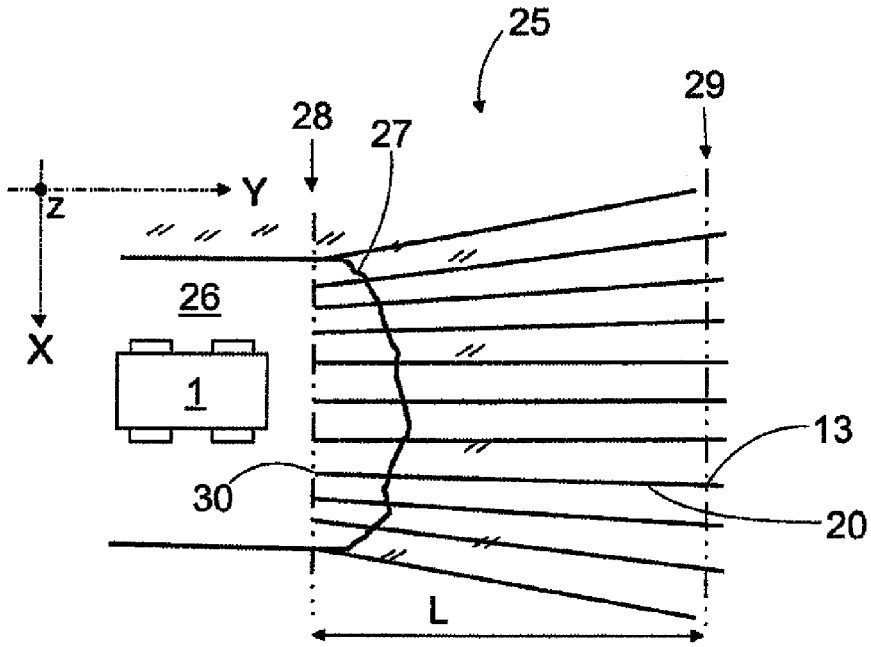

FIG. 3 shows the principle of a drilling pattern 12 in association with a round 25 to be drilled. A face 27 of a tunnel 26 to be excavated is provided with a navigation plane 28 whereto the coordinate system of the drilling pattern 12 is attached. The navigation plane 28 is usually at the front of the face 27, but sometimes it may be located at least partly inside the rock. The drilling pattern 12 may include a determined location and direction of the rock-drilling rig 1 in the coordinate system, in which case the rock-drilling rig 1 is navigated in accordance with the coordinate system before the drilling is started. The bottom of the round 25 may further include a blast plane 29 at a distance L corresponding to the length of the pattern from the navigation plane 28. The locations 13 of the bottoms of the holes to be drilled may be placed at the blast plane 29 during the planning of the drilling pattern 12. The direction 20 of the hole to be drilled may be input in the drilling pattern design program, allowing the drilling pattern design program to calculate a starting location 30 for the drill hole at the navigation plane 28 on the basis of the location 13 and direction 20 of the drill hole bottom. Alternatively, the starting location 30 of the drill hole at the navigation plane 28 may be input in the drilling pattern design program, allowing the drilling pattern design program to calculate the direction 20 of the drill hole on the basis of the location 13 of the drill hole bottom and the starting location 30 of the drill hole. Accordingly, drill hole properties are determined from the bottom of the round 25 towards the navigation plane 28, whereas conventionally, the examination takes place from the navigation plane towards the bottom of the round, i.e. exactly oppositely. A blasting-technical calculation may be performed at the blast plane 29 during the planning of the locations 13 of the drill hole bottoms.

In the final drilling pattern, the locations of all drill hole bottoms are not necessarily located at the blast plane, since the bottom of the drilling pattern is typically shaped concave. Field holes may extend longer in the y direction than the holes of the end profile and the aid rows. However, the bottom of the drilling pattern is not shaped until the locations of the drill hole bottoms are first placed at the same plane in the xz direction, the blast plane, for example. This simplification facilitates planning and improves clarity. The shaping of the bottom of the drilling pattern may be affected by means of the depth dimensions and hole direction angles of the drill holes.

Figure 4:
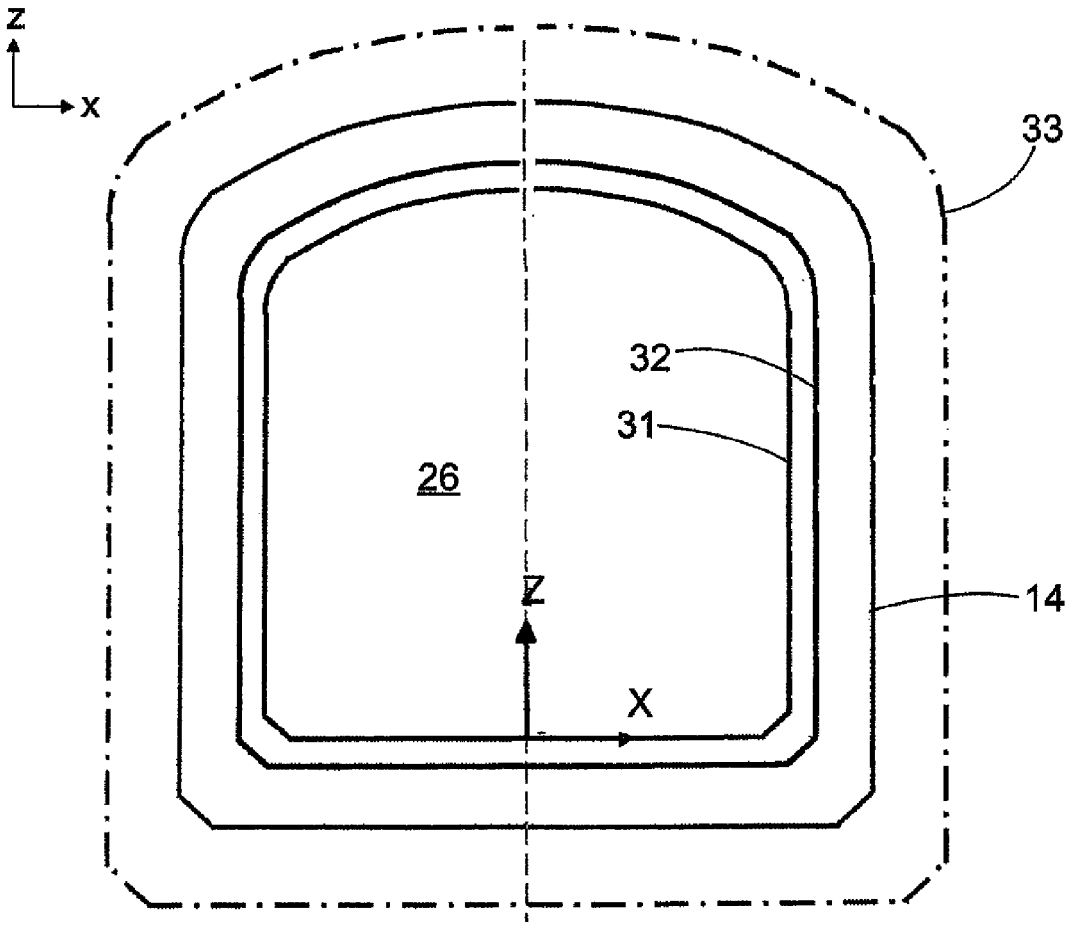

FIG. 4 illustrates some profiles and groups of holes of a drilling pattern 12. A theoretical excavation profile 31 determined by the orderer of the rock cavern 26 is one of the basic pieces of information to be input in the drilling pattern design program. Furthermore, the orderer may determine allowed tolerances for the theoretical excavation profile 31, which may also be used as basic information in the pattern planning. FIG. 4 further shows a start profile 32 that may be determined at the navigation plane 28. The drilling of the drill holes may start from the start profile 32 at the navigation plane 28. The end profile 14, in turn, is a line connecting the ending points of the holes of the outermost drill hole profile. Furthermore, the orderer may determine the largest allowed cracking zone 33 for the rock cavern 26, setting the limit beyond which any cracking caused by the blasting of an explosive is not allowed to advance in the surfaces limiting the rock cavern 26. An examination of the cracking zones may be performed when drill hole bottom locations are placed in the end profile 14 and on the outermost aid rows 15 and 16, and the cracking zones are determined for them on the basis of predetermined blasting information.

Figure 5:
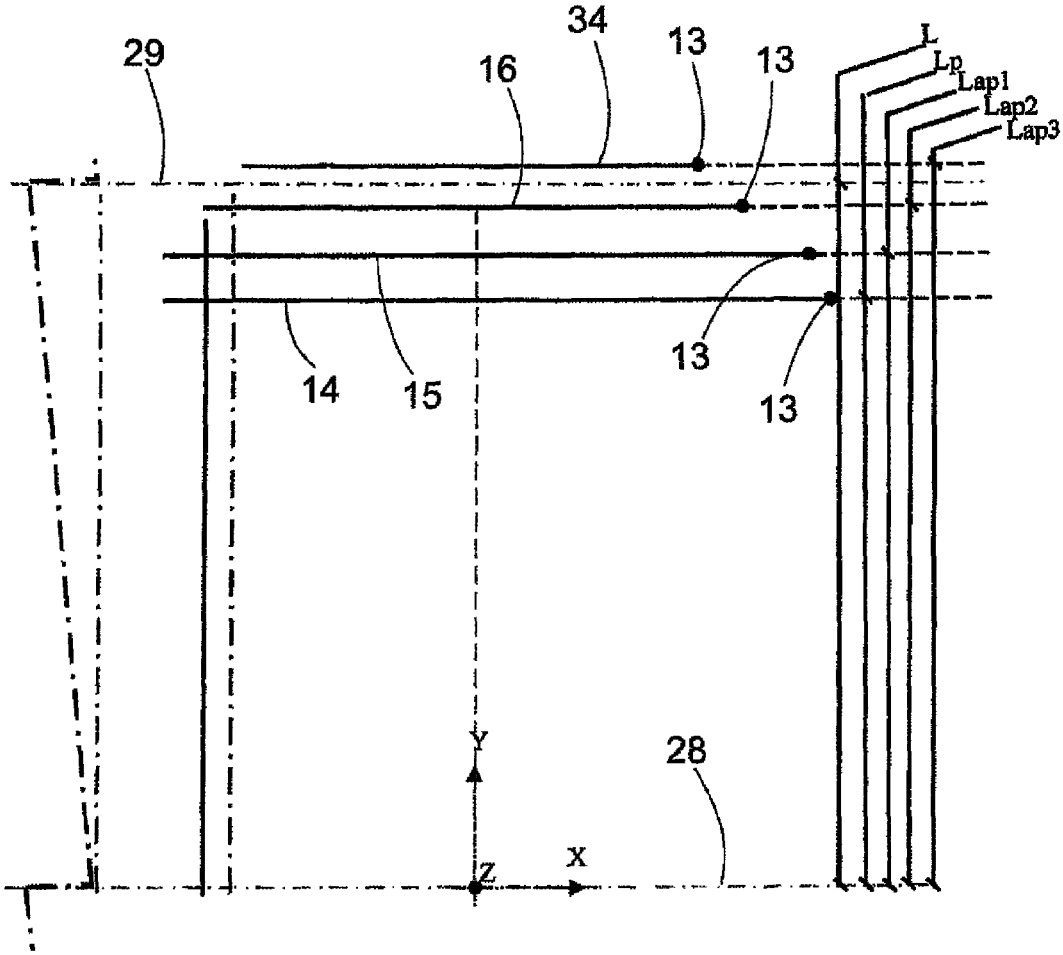

FIG. 5 shows that the depths of the drill holes in the different groups of holes 14, 15, 16 and 34 may be different. In the figure, the depth of the end profile 14 is denoted by reference mark Lp, the depth of the outermost first aid row 15 is denoted by reference mark Lap1, the depth of the second aid row by reference mark Lap2 and, further, the depth of the third aid row by reference mark Lap3. The length of the pattern, i.e. the distance between the navigation plane 28 and the blast plane 29, is denoted by reference mark L. The ending points of the holes are denoted by reference marks 13 in the figure.

FIGS. 6*a* and 6*b* illustrate the placement of the ending points of the drill holes in a group of holes. The placement of the drill holes may be started from the end profile 14. Once the locations of the drill holes are placed in the end profile 14, the drilling pattern design program may assist in the determination of the aid rows required. The placement of the ending points of the drill holes in the group of holes may be iterative, i.e. the locations of the drill hole bottoms placed in the group of holes may be changed later if need be. FIGS. 6*a* and 6*b* show the locations of the bottoms of so-call hole location masters 35 by a black circle, and the locations of the bottoms of the intermediate holes 36 between two hole location masters by a white circle.

Charge classes may be determined in a group of holes for the sections between the hole location masters 35. For example, the bottom 14*a* of the end profile 14 may have a charge class that differs from that of the wall 14*b* of the end profile. Furthermore, a curved roof 14*c* of the end profile 14 may be marked off by means of the hole location masters 35, or any other section of the group of holes, and this section may be assigned a specific charge class. The specific charges (q1 to q4) of the different sections of the group of holes, bottom, wall, roof, may be different because of the different quality requirements of these sections as regards the cracking zone, for example. Thus, the charge class determines at least the specific charge q to be employed. The starting values of the parameters of the charge classes may be stored in a specific charge table according to FIG. 7 or the like. The use of such preset parameters enables the user to avoid unnecessary input of numerical data. However, the user is able to change the desired parameters and store new parameters in the specific charge table, which may again be taken as the starting location in the blasting-technical examination of the following pattern.

In practice, the designer places hole location masters 35 in a group of holes, and then determines the charge class of the section between the hole location masters 35. The drilling pattern design program is then able to automatically place a number corresponding to the charge class of intermediate holes 36 at equal intervals in the section between the hole location masters 35. This being so, the drilling pattern design program pays attention to, not only the specific charge degree, but also a predetermined maximum hole spacing or the target hole spacing.

In FIG. 6*a*, in the bottom section 14*a* between the hole location masters 35*a* and 35*b*, the specific charge is q1, the hole spacing being E1. The wall section between the hole location masters 35*a* and 35*c*, in turn, has a different specific charge q2 and hole spacing E2. If the designer does not accept the locations or number of intermediate holes 35 placed by the drilling pattern design program, the designer is able to manually change them. Furthermore, the designer is able to move a hole location master in a drill hole group, remove a hole location master, add a hole location master or convert an intermediate hole into a hole location master. Thus, the master holes are not bound in advance to any specific group of holes or the like. Thus, the pattern can be modified versatilely, allowing it to be used as the starting location of a new pattern. Consequently, the pattern has a long operational life.

FIG. 6*b* shows a situation wherein, compared with the situation shown in FIG. 6*a*, the designer has wanted to increase the number of drill hole bottom locations in the left lower corner A of the end profile 14. The designer has thus determined two new hole location masters 35*d* and 35*e* in the vicinity of corner A. The designer is able to assign a charge class to section 14*d* between the hole location masters 35*a* and 35*d*, and, in a corresponding manner, to section 14*f* between the hole location masters 35*a* and 35*e*. The drilling pattern design program places intermediate holes 35 in sections 14*d* and 14*f* on the basis of the parameters of the charge class. Alternatively, the designer may manually determine the required parameters for sections 14*d* and 14*f*, such as hole spacing E and specific charge q. The designer may determine the parameters or the charge class in such a manner that the hole spacing E in the section marked off by hole location masters 35 is as desired. This has no effect on other marked-off sections 14*e* and 14*g* of the end profile, but in these sections hole spacing E1, E2 and specific charges q1 and q2 remain unchanged. Should the designer later remove hole location master 35*d*, for example, the situation is restored accordingly to comply with FIG. 6*a*, i.e. section 14*b* having a hole spacing of E2 and a specific charge of q2 exists between hole location masters 35*a* and 35*c*. The designer is even later on otherwise able to edit the pattern and change the location and number of hole location masters 35, and change the parameters as well as the charge classes associated therewith.

FIG. 7*a* shows a specific charge table wherein the parameters to be used as starting values are determined for a blasting-technical examination and the placement of drill hole bottoms. For each group of holes as well as for each end profile, aid row and field element, charge classes, the amount of explosive per volume unit kg/m3, i.e. specific charge q, the charge identifier, i.e. chargeID, the target hole spacing $E_t$ and the maximum allowed hole spacing $E_m$, may be determined. Furthermore, it is possible to determine other parameters for the specific charge table, such as whether an even number of intermediate holes is required in the section between the hole location masters, for example. In addition, a target ratio F, which is the quotient of hole spacing E and burden V, may be determined in Table 7a for each group of holes. ChargeID, shown in Table 7a, may link a drill hole to a file or a data element, such as Table 7b, which may contain information associated with the explosive, such as specific charge q [$kg_{anfo}$/m], size [m] of cracking zone caused by explosive and other necessary charging information. The use of tables speeds up planning work and they are easy and fast to modify, if need be.

Figure 8:
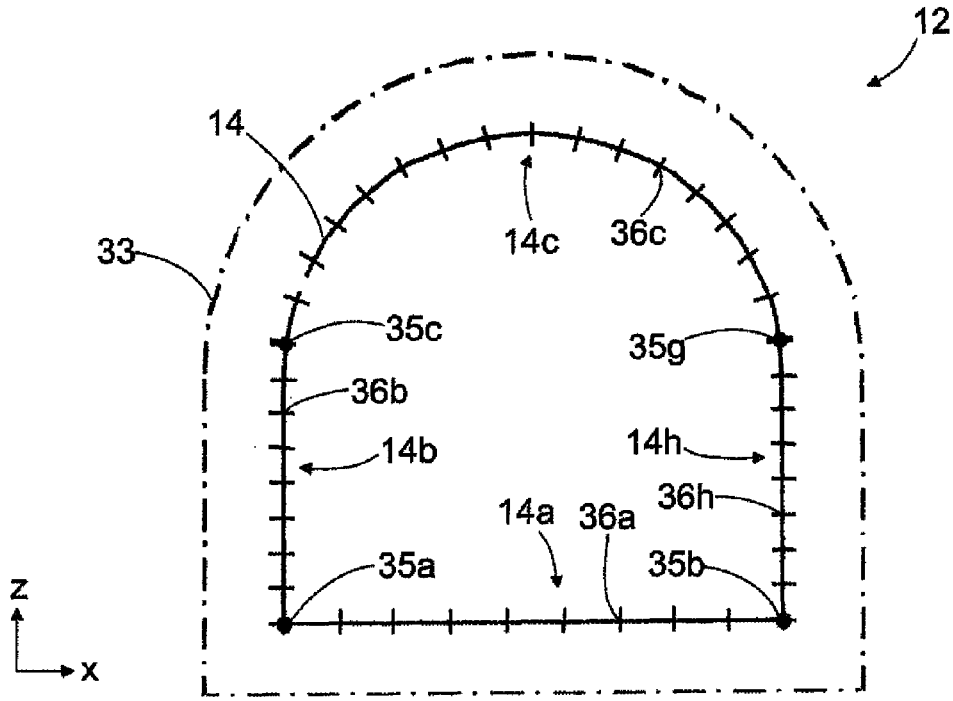

FIG. 8 shows a situation wherein the drilling pattern design program has set the locations of the bottoms of intermediate holes 36*a*, 36*b*, 36*c* and 36*h* at equal distances in the different parts 14*a*, 14*b*, 14*c* and 14*h* of the end profile, the parts being marked off by means of hole location masters 35*a*, 35*b*, 35*c* and 35*g*. For the sake of clarity, the locations of the bottoms of the intermediate holes are shown by a line transverse relative to the element line of the end profile 14. FIG. 8 further shows the allowed cracking zone 33 around the end profile. Blasting explosive in a drill hole causes not only rock to be detached but also cracking in the rock remaining in the walls of the rock cavern. The cracking phenomenon weakens the walls of the rock cavern, and therefore the orderers of the work typically determine the maximum allowed advance of the cracking zone, for example 400 mm. Thus, the cracking zone 33 is a quality requirement set on the mining. The different sections of the pattern may have different quality requirements as regards cracking, whereby also the allowed cracking zone 33 may be of a different size in the different sections. Graphic presentation of the cracking zone 33 on the display of the control unit substantially improves the clarity of the examination. The profile 33 of the allowed cracking zone may be displayed in the graphic user interface not only at the blast plane 29, but also at the navigation plane 28, and between the blast plane and the navigation plane, as is shown later in FIG. 10.

Figure 9:
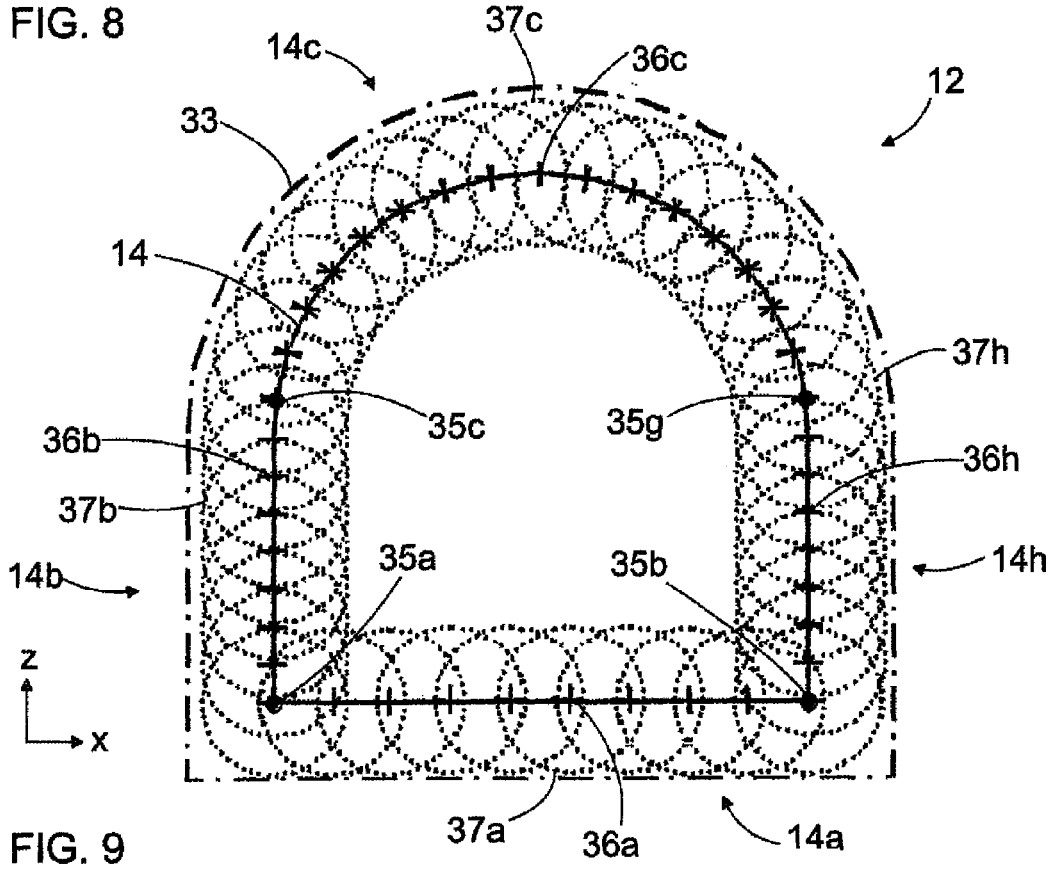

FIG. 9 illustrates cracking examination. The magnitude of the cracking caused by the blast of an explosive may be determined by performing a cracking zone examination on the drill holes in the end profile. The designer may select the charges to be used in the individual drill holes or the charges to be used in each section 14*a*, 14*b*, 14*c*, 14*h* and other factors associated with charging in a manner eliminating the extension of drill hole cracking up to the allowed cracking zone. The size of the cracking zone is particularly affected by the explosive used and the degree of charge. In addition, the proportion of the diameter of the charge to the diameter of the drill hole, i.e. how tightly the charge is arranged in the drill hole, may affect the size of the cracking zone. In addition, differences in the ignition times of the detonators may affect the size of the cracking zone. These charging data may be tabulated or otherwise arranged as a data element that the drilling pattern design program is able to use in the cracking zone examination. The cracking zone examination is carried out at least at the blast plane 29, but it may also be carried out in the section between the navigation plane 28 and the blast plane 29, as will be illustrated later in FIG. 10.

Furthermore, the cracking zone examination may be carried out, if need be, not only for the drill holes of the end profile 14, but also for those of the first aid row 15 and sometimes also for those of the second aid row 16. The cracking zone of the aid rows 15, 16 may be managed by changing the size of the charge to be used or, alternatively, by changing the hole spacing E of the outermost aid row or the end profile. In fact, a change in the hole spacing E affects the burden V, which again affects the distance between the end profile 14 and the first aid row 15. The larger the distance of the outermost aid rows 14, 15 from the allowed cracking zone 33, the more assuredly is the cracking of the drill holes therein in control.

The cracking zone examination may be displayed clearly in the graphic user interface of the designing computer or the rock-drilling rig, whereby the designer may take it actively into consideration when designing the drilling pattern. In addition to the allowed cracking zone profile 33, also the cracking zone of each drill hole 35, 36 may be displayed at the user interface as a cracking circle 37, generated at least around the drill hole bottoms on the end profile 14. The size of the diameter of the cracking zone is proportional to the size of the cracking zone determined by the drilling pattern design program. None of the cracking circles 37 may intercept the profile 33 of the allowed cracking zone. Should this occur, the drilling pattern design program may indicate it to the user, who may then change the blasting-technical parameters to amend the situation. The use of cracking circles 37 significantly increases clarity.

Figure 10:
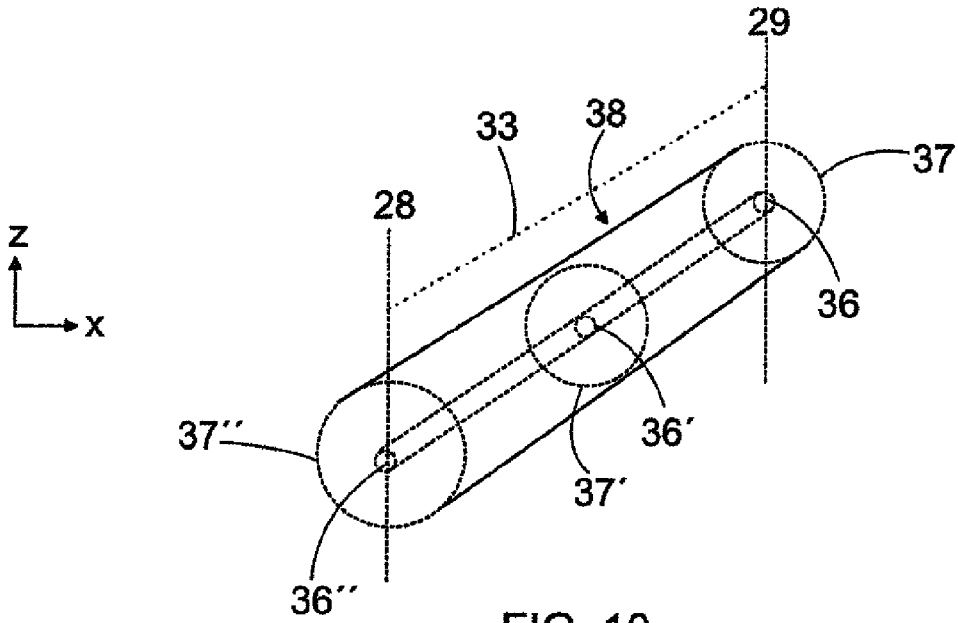

FIG. 10 shows that a cylindrical cracking space 38 may be generated between the navigation plane 28 and the blast plane 29, the ends of the cracking space being the cracking circle 37 generated at the blast plane 29 and the cracking circle 37" generated at the navigation plane 28. Thus, each point of the centre line passing through the bottom and starting location of each drill hole 36 comprises a cracking circle 37', such as in point 36', for example. The drilling pattern design program indicates to the designer if even one cylindrical cracking space 38 intercepts the profile 33 of the allowed cracking zone between the navigation plane 28 and the blast plane 29. The cracking circles 37 and the cracking spaces 38, visually displayed in the user interface, indicate clearly to the designer whether the drilling pattern 12 corresponds to the requirements set as regards the cracking zones.

Figure 11:
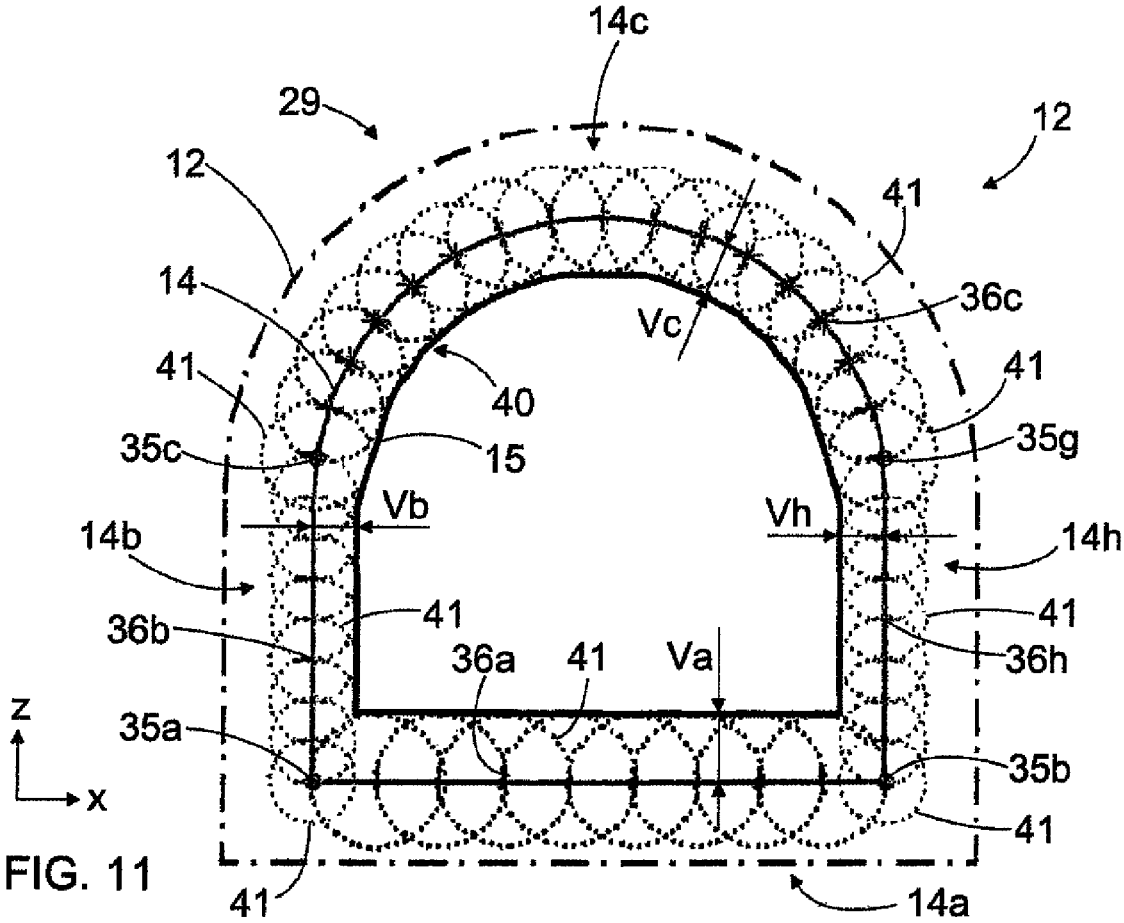

FIG. 11 illustrates calculation of burden V and illustration of burden V in a graphic user interface by means of circles of burden 39. Once the drill hole bottom locations are placed on the end profile 14, and a cracking zone examination is performed thereon, burdens are calculated for the drill holes placed in the end profile 14 by utilizing blasting-technical calculation. The blasting calculation is performed at the blast plane 29. In burden V calculation, formula $V=I/(q*E)$, may be employed, wherein q is specific charge value, E is hole spacing and I is average degree of charge. These blasting-technical parameters may be predetermined for instance as a file, a table or a corresponding data element, from where they may be loaded for use by the drilling pattern design program. Burden V is the shortest distance from each bottom of the drill holes 35, 36 of the end profile 14 to the following row of holes, i.e. to the first aid row 15. The different sections 14*a*, 14*b*, 14*c* and 14*h* of the end profile 14 may have burdens Va, Vb, Vc and Vh of equal or different sizes depending on the blasting-technical parameters determined for the drill holes of the end profile 14. Once the burdens are calculated, a burden line 40 may be determined at the blast plane 29 for the drill holes 35, 36 of the end profile 14 at a distance equal to the determined burdens V to the inside of the end profile 14. Thereafter the outermost aid row 15 may be placed on the burden line 40 of the end profile 14. In this way, the first aid row 15 has been generated by means of blasting-technical calculation. The end profile, the burden line and the locations of the drill hole bottoms may be displayed visually in a graphic user interface. Furthermore, a circle of burden 41 may be generated for each drill hole 35, 36 of the end profile 14 around the drill hole bottom. The circle of burden 41 is generated in such a manner that the size of its radius is proportional to the size of the burden V. In this case, the burden line 40 is an envelope that touches the circumference of each circle of burden 41 at one point in its inner edge. The circles of burden 41 and the burden line 40 may be displayed in a graphic user interface in order to improve clarity.

FIG. 12 shows that after the generation of the first aid row 15, several locations 42 for drill hole bottoms having the desired hole spacing E between them may be determined for it at the blast plane 29. The same principles are associated with the placement and properties of the drill holes 42 as were described above in connection with holes 35 and 36 of the end profile. Accordingly, the aid row may also include master holes and intermediate holes. Furthermore, the location and number of holes and the blasting-technical parameters associated therewith may be easily changed during iterative planning and also later during editing of the pattern 12. Furthermore, burden calculation may be performed on the drill holes 42 placed on the first aid row 15 at the blast plane 29 in a manner allowing a second burden line 43 to be generated, for which a second aid row 16 may be determined. As FIG. 12 shows, circles of burden 44 may be generated around the drill hole bottoms 42. In a corresponding manner, the required number of inner aid rows may be generated and drill hole bottom locations may be placed thereon at the desired distances from each other.

Once the innermost aid row is generated and the drill hole bottom locations are placed thereon, a cut 18 may be placed in the pattern 12 in the manner shown in FIG. 2. In the pattern 12, a predetermined cut 18 may be used, which may be loaded from some memory element or, alternatively, the designer may manually determine the blasting-technical parameters of the cut and the location thereof. Once the cut 18 is placed, field drill holes 17 are placed in the pattern 12 for filling the section between the innermost aid row and the cut 18. The designer is able to place the field drill holes 17 manually or the drilling pattern design program may assist in the placement of the field drill holes 17. Blasting-technical burden V calculation may be utilized in the determination of the locations of the field drill holes and the elements 17.

FIG. 13 shows corner A of the end profile 14, wherein hole depth masters 45*a*, 45*b* and 45*c* are determined in the section of the bottom 14*a*. The hole depth masters 45 determine the coordinates of the ending points of the drill holes in the y direction. Default depths may be determined for the hole depth masters 45 by means of the basic dimensions of the pattern. Basic dimensions include the L dimensions previously shown in FIG. 5, i.e. pattern length L, end profile length Lp, depth of first aid row Lap1, etc. When locations of drill hole bottoms are placed in the groups of holes, their depth is determined according to the default depth of said group of holes. If desired, the designer may edit the hole depth masters 45 by giving them y coordinate values deviating from the default values. In addition, the designer may add and remove hole depth masters and move them along the element line of the group of holes.

FIG. 14 shows that a hole depth master 45*a* is located at a default depth Lp. However, the designer has determined the y coordinates of hole depth masters 45*b* and 45*c* different from the default depth Lp. This being the case, the drilling pattern design program may interpolate the depths of the intermediate holes 47 in section 46*a* between the two hole depth masters 45*a* and 45*b* and, similarly, in section 46*b* between the two hole depth masters 45*b* and 45*c* on the basis of the number of intermediate holes 47 between the hole depth masters and the lengths of the hole depth masters 45. If intermediate holes 47 between the hole depth masters 45 are added or removed later or the values of the hole depth masters 45 are changed, the drilling pattern design program is able to perform a new interpolation to determine new depths for the intermediate holes 47. The hole depth masters 45 enable the designer to deviate from the default depths of the groups of holes when required in the desired sections of the drilling pattern. Hole depth masters 45 may be positioned in any group of holes.

Figure 15:
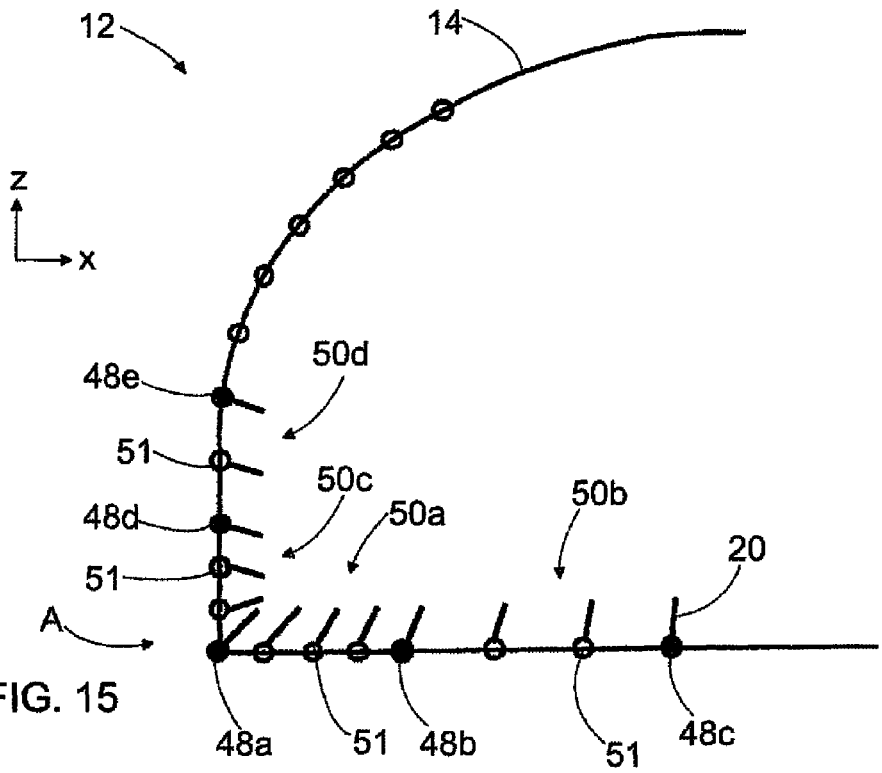

FIG. 15 shows corner A of the end profile 14, in which hole direction masters 48*a* to 48*e* are placed, for which hole direction angles have been determined. A hole direction angle may be illustrated in a graphic presentation by a directional line 20 marked in connection with a circle or the like depicting the drill hole bottom. The hole direction masters 48*a* and 48*b* define, between them, a section 50*a* including intermediate holes 51. In the same way, the hole direction masters 48*b* and 48*c* define section 50*b*, the directional master holes 48*a* and 48*d* section 50*c*, and, furthermore, the hole direction masters 48*d* and 48*e* section 50*d*. The drilling pattern design program may interpolate hole direction angles for the intermediate holes 51 between the two hole direction masters 48 on the basis of the number of intermediate holes between the hole direction masters and the hole direction angles of the hole direction masters. If intermediate holes 51 between the hole direction masters 48 are added or removed later or the values of the hole direction masters 48 are changed, the drilling pattern design program is able to perform a new interpolation to determine new hole direction angles for the intermediate holes 51.

It should be noted that a drill hole belonging to a group of holes may simultaneously possess two or more master hole properties. Consequently, for instance a hole location master may simultaneously be a hole depth master and a hole direction master, i.e. a kind of multimaster hole.

Let it be mentioned that the term drill hole element may also be employed of the section between two master holes instead of the previously used term section. A drill hole element comprises an element line having a first master hole, a second master hole and, between them, one or more intermediate holes. Master holes are placed on a profile, whereby the shape of the element line between them corresponds to the shape of the profile at the drill hole element.

Figure 16:
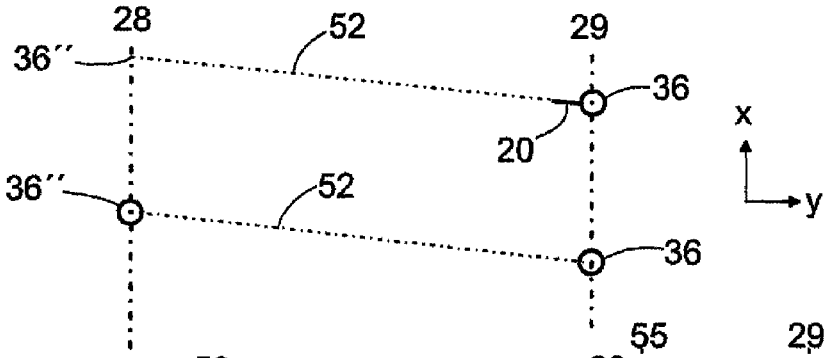

FIG. 16 shows that, when the location 36 of a drill hole bottom is known at the blast plane 29 and the direction 52, the drilling pattern design program is able to determine the starting location 36" of the drill hole at the navigation plane 28 on the basis of these data. The lower presentation of FIG. 16 further shows that by supplying the starting location 36" of the drill hole at the navigation plane 28 to the drilling pattern design program, the program is able to determine the direction 52 of the drill hole on the basis of the starting location 36" and the location 36 of the bottom.

Figure 17:
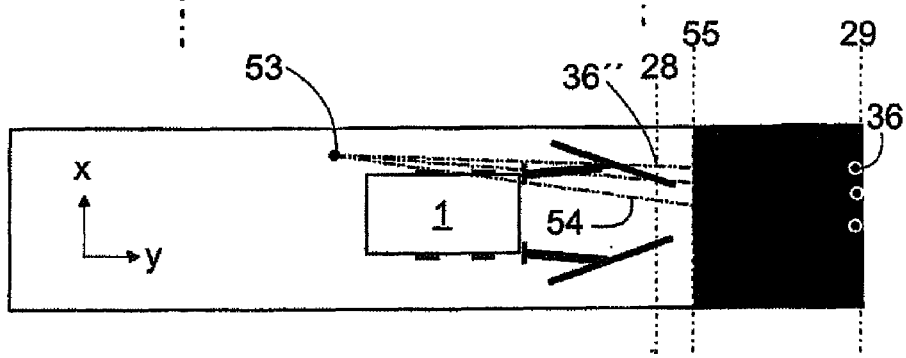

FIG. 17 shows still another alternative arrangement for determining the directions and the starting location 36" of a drill hole at the navigation plane 28. The designer is able to determine an alignment point 53 and select one or more drill holes 36 that may be aligned according to the alignment point 53. The drilling pattern design program determines the alignment in such a manner that extensions 54 of the selected drill holes 36 pass through the selected alignment point 53. This allows the starting locations 36" of said drill holes to be determined at the desired plane. The starting locations 36" may be determined at the navigation plane 28 or a starting plane 55, from which actual drilling starts. The designer may indicate the alignment point 53 in the graphic user interface with some indicator means, such as a mouse, for example. Alternatively, the designer may input the coordinates of the alignment point in the coordinate system of the drilling pattern in the drilling pattern design program. Furthermore, the drilling pattern design program may load information about the rock-drilling rig to be used, and display the figure of the rock-drilling rig 1 in connection with the planned drilling round. In this case, the designer may determine the location of the rock-drilling rig 1 at the tunnel face and then determine the alignment point from the backside of the rock-drilling rig 1. The designer may use visual examination to ensure that the drill holes aligned in accordance with the alignment point 53 and the bottoms 36 of the drill holes can be drilled without obstacle with the drilling booms of the rock-drilling rig 1. The alignment point 53 may be applied to not only the drill holes in the profile and on the aid rows, but also to the determination of the hole direction angles of field holes and individual additional holes.

Figure 18:
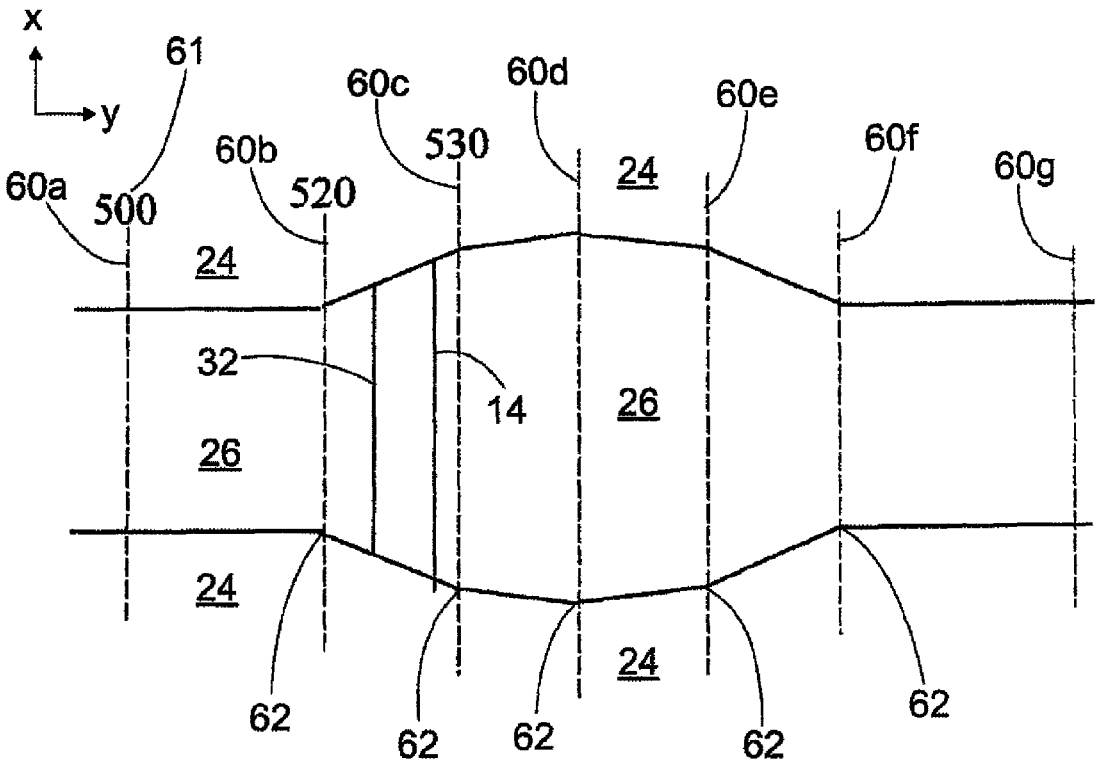

FIG. 18 shows a trumpet-like transition of a rock cavern to be generated, seen as an xy projection. A trumpet-like transition means that the profile of the rock cavern 26 widens or shrinks at the xz plane, when examined in the y direction. Peg numbers 60*a* to 60*g* transverse to the y direction may be determined in the drilling pattern, which may be identified for instance by a numerical value 61, which may thus depict for instance the number of metres from a predetermined starting location. The peg numbers 60 may be determined at the desired distances from each other, for instance one metre. In FIG. 18, peg numbers 60*b* to 60*f* are located at transition points 62 of the trumpet-like transition, i.e. at points wherein the profile of the rock cavern 26 to be excavated changes. The necessary drill hole profiles, such as start profiles and end profiles, may be determined by means of the drilling pattern design program at the desired peg numbers. In addition, drilling patterns may be designed by means of the drilling pattern design program at the desired peg numbers. Furthermore, the direction of the centre line of the rock cavern 26 is typically determined by means of curve tables and the like, for example.

The start profile 32 and the end profile 14 may be interpolated by means of the drilling pattern design program for any peg number. In the example of FIG. 18, interpolation is performed between peg numbers 60*b* and 60*c*. In this case, the drilling pattern design program interpolates the initial and end profiles according to the profiles of peg numbers 60*b* and 60*c* and displays them in a graphic user interface to the designer. A condition for interpolation is that the profiles are uniform in the previous and the latter peg number. In practice, the task of the designer is only to select the desired curve table, the peg number and the length of the drilling pattern and then initiate the interpolation function.

Figure 19:
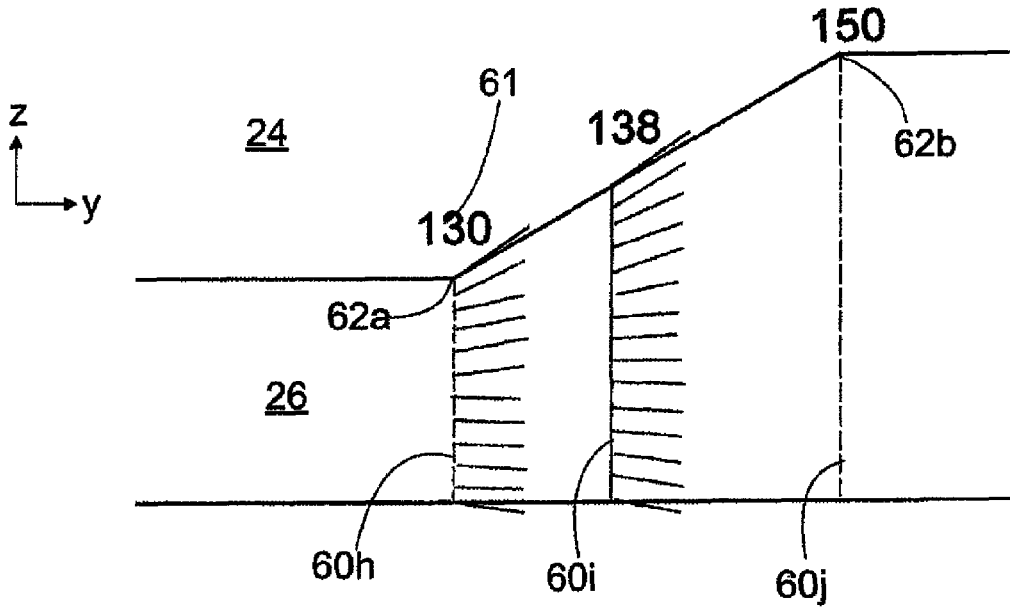

FIG. 19 shows an application that can be utilized in association with a rock cavern 26 having a changing profile. When the rock cavern 26 shows a trumpet-like transition, a drilling pattern may be designed intelligently for any peg number 60*i* situated between transition points 62*a* and 62*b* on the basis of the drilling pattern of the previous transition point 62*a* and the profile of the following transition point 62*b*. The drilling pattern design program takes the drilling pattern designed for peg number 60*i* as the starting location and adds, thereto, drill hole locations in such a manner that burden V and hole spacing E remain unchanged in the drilling pattern. In addition, the hole direction angles of the drill holes remain the same. The purpose of the applications shown in FIGS. 18 and 19 is to facilitate and speed up the designing of the drilling pattern in special occasions.

Figure 20:
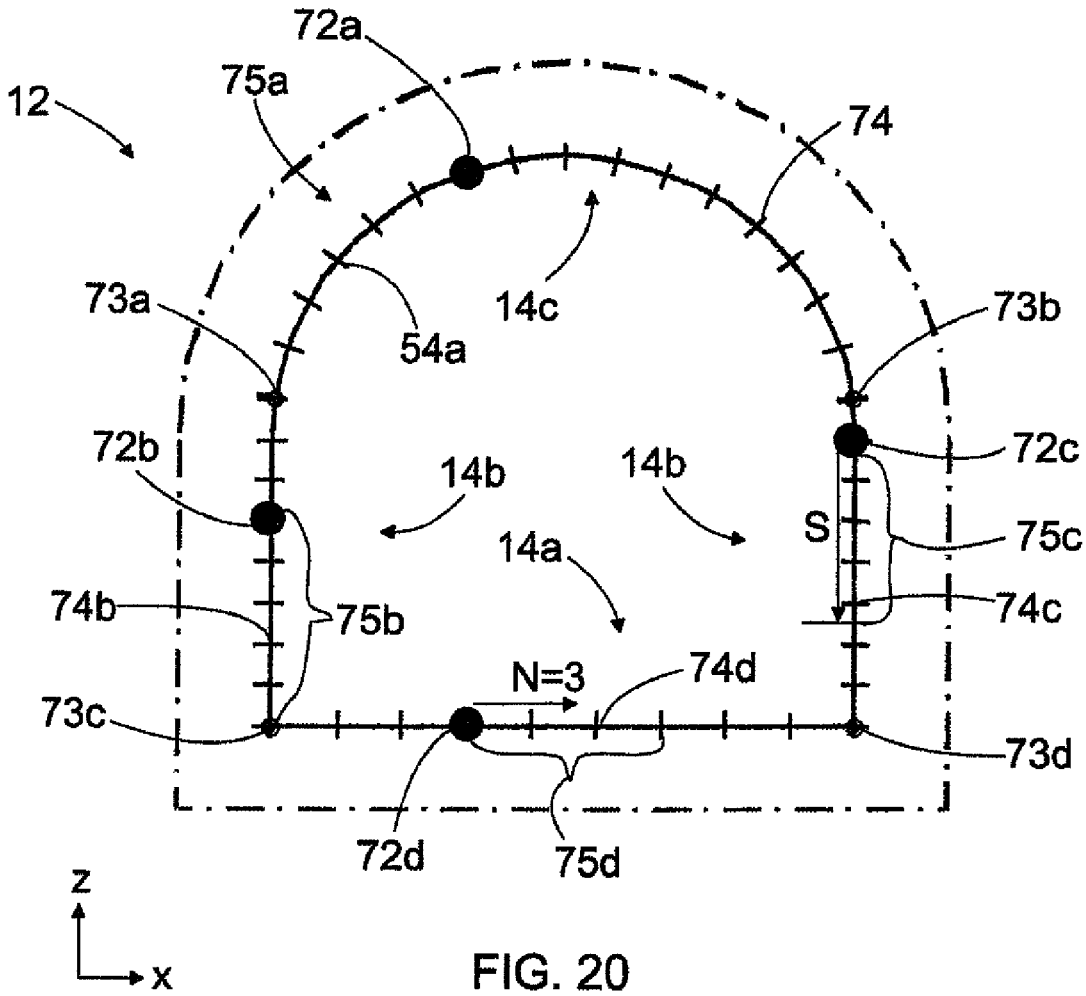

FIG. 20 shows yet some applications of master holes. The drill hole properties of the sections of the drilling pattern 12, such as the bottom 14*a*, the wall 14*b* and the curved roof 14*c*, may be determined by placing a master hole in each section. For example, in FIG. 20, a master hole 72*a* is positioned in the roof section 14*c*, the hole affecting the properties of intermediate holes 74*a* between ending points 73*a*, 73*b* of the roof section 14*c*. Corresponding master holes may also be positioned in the wall sections 14*b* and the bottom section 14*a*. For such master holes, a rule has been pre-determined, according to which one of the sections 14*a* to 14*c* of the drilling pattern 12 is their area of influence. Furthermore, it is possible to position a master hole 72*b* in the drilling pattern 12, the area of influence 75*b* of this master hole being determined as the section of the group of holes that remains between the master hole 72*b* and the corner point 73*c* of the pattern. In this case, the dominating properties of the master hole 72*b* affect the properties of the intermediate holes 74*b*. Instead of the corner points 73*c*, the area of influence may be determined according to ending points 73*a*, 73*b* other than the corner points 73*c*, 73*d*. In addition, the area of influence 75*c* of the master hole 72*c* may be determined as an absolute distance S, whereby the master hole 72*c* affects all intermediate holes 74*c* at the end of said distance S. Furthermore, a direction of influence has been predetermined for such a master hole 72*c*, the direction being shown by an arrow in FIG. 20. It is also possible to use a master hole 72*d* in the drilling pattern, the determined area of influence 75*d* of this master hole being the number N of adjacent drill holes 74*d*. In addition, a direction of influence is determined for such a master hole 72*d*, the direction being shown by an arrow in the figure. The areas of influence 75*c* and 75*d* of the master holes 72*c* and 72*d* may be determined to extend in one direction or alternatively in two directions. Furthermore, the magnitude of the area of influence may be different in different directions. Thus, the area of influence may be e.g. three adjacent drill holes to the right and two adjacent drill holes to the left. A master hole may also have some combination of the above-described areas of influence, i.e. the area of influence may cover three adjacent drill holes in one direction and, in the other direction, it may extend to the ending point or the like of some section of the pattern. Any other rule than what was described above may be set for the determination of the area of influence 75 of the master hole 72. The dominating properties, the location and the determination of the area of influence of the master holes may be edited later. The rule determining an area of influence may be stored in the same or a different file, data element or the like as/than the dominating properties of the master hole. A master hole having a predetermined area of influence may be of any type, i.e. it may be a hole location master, a hole direction master, a hole depth master or any other master hole determining one or more properties.

The drilling pattern according to the invention may be modified versatilely. A new drilling pattern may be designed by modifying an existing old drilling pattern. This saves the time consumed by planning. Furthermore, specific charge values and hole direction angles that were previously found working may be utilized. An old drilling pattern may be loaded from the memory of the system as the basis for a new pattern. The designer may then transfer drill hole elements present in the pattern, and add and remove them. The designer may also zoom the drilling pattern in or out. The designer may also freely add master holes to the drilling pattern or remove them. Similarly, the designer may modify the contents of the starting value tables before they are loaded by the drilling pattern design program. The cut of an old drilling pattern may be used as such or its location in the drilling pattern may be shifted. Alternatively, the cut may be replaced with another cut that may be loaded from another drilling pattern.

Various starting value tables, parameter tables and parameter files, the parameters stored in which may be loaded for use by the drilling pattern design program at any time, may be created for the designing of a drilling pattern. In addition, for blasting-technical calculation, other formulas than those mentioned in the present application may be given to the drilling pattern design program.

The drilling pattern design program may comprise a simulation program. After the drilling pattern is created, the pattern may be subjected to a rationality examination, i.e. a performance test, before it is delivered and taken into use in the rock-drilling rig. It is also possible to subject the drilling pattern to a rationality examination at any stage of the designing of the drilling pattern, enabling the designer to immediately make the necessary amendments in the drilling pattern. The simulation program included in the drilling pattern design program may run through the drilling sequences, i.e. virtually position the drilling boom at each drill hole and drill the holes. The simulation program may also include automatic checks, allowing it to indicate deficiencies and dangerous situations in the drilling pattern to the designer. The rationality examination enables the observation of holes, during whose drilling an obvious risk exists of the drilling booms colliding into each other or a risk exists of the drilling boom and the feeding device colliding into each other, for example. In addition, a check may be made to see that the drilling booms can be extended to drill all drill holes and that the operator of the rock-drilling rig has good visibility to the drilling site. Furthermore, simulation enables the observation of any information missing from the drilling pattern. During simulation, the designer planning the drilling pattern may also follow the run of the drilling sequence and visually observe errors and drawbacks therein.

For the run of the simulation program, the information and the visual model of the rock-drilling rig may be retrieved from a pre-generated file. The simulation program may display the drilling pattern seen from the drilling direction and from above. The drilling pattern may also show a figure of the rock-drilling rig and the fastening point of the drilling boom, the drilling boom, and angles of the articulations of the drilling boom, rollover angles, for example. The designer may affect the simulation run by speeding up or slowing down the run and by winding it forward and backward. Furthermore, during simulation, the positioning movements of the boom may be arranged to be displayed slower than the drilling, facilitating the examination of critical steps.

The drilling pattern design program is a software product executable in a processor of a computer or the like. The software product may be stored in a memory means of the computer used in the designing or it may be stored in a separate memory means, such as a CD ROM, for example. Furthermore, the software product may be loaded to the computer used in the designing from an information network. The execution of the drilling pattern design program is adapted to achieve the functions described in the present application. The drilling pattern design program and the designer may operate interactively and thus together design the drilling pattern.

In some cases, the features described in the present application may be used as such, irrespective of other features. On the other hand, the features presented in the present application may be combined to generate various combinations, when required.

The drawings and the related description are only intended to illustrate the idea of the invention. The details of the invention may vary within the scope of the claims.

The invention claimed is:

1. A method of designing a drilling pattern for excavating a rock cavern, the drilling pattern determining at least the locations and hole direction angles of drill holes in a coordinate system of the drilling pattern and the lengths of the drill holes for a round to be drilled at a tunnel face, the method comprising:

computer-aided designing of the drilling pattern by means of a drilling pattern design program, determination of a navigation plane for the drilling pattern;

determination of at least an excavation profile for the cavern to be excavated, at least one group of holes inside the excavation profile, and a length of the drilling pattern on the basis of a length of the round to be excavated;

determination of a plurality of drill holes for each group of holes;

determination of starting locations at the navigation plane for the holes to be drilled;

determination of the directions of the holes to be drilled from the starting locations to the bottoms of the holes;

and the method further comprising determining, in the drilling pattern, a blast plane located at a bottom of the round at a distance corresponding to the length (L) of the pattern from the navigation plane;

placing drill hole bottom locations at the bottom of the round at the blast plane;

performing blasting calculation at the blast plane for at least some holes in the drilling pattern;

utilizing blasting-technical data stored in advance in a memory for the blasting calculation; and supplying one of the following drill hole properties to the drilling pattern design program: drill hole start location at navigation plane, drill hole direction, and determining a missing second drill hole property on the basis of the location of the drill hole bottom and the supplied drill hole property, the drill hole properties being determined viewed from the bottom of the round towards the navigation plane.

2. A method as claimed in claim 1, comprising utilizing mutual dependencies, stored in advance in a memory, between burden, hole spacing, specific charge and degree of charge and blasting-technical data, stored in advance in a memory, about the specific charge and the degree of charge in the blasting calculation.

3. A method as claimed in claim 1, comprising:

utilizing mutual dependencies, stored in advance in a memory, between burden (V), hole spacing (E), specific charge (q) and degree of charge (I) and blasting-technical data, stored in advance in a memory, about the specific charge (q) and the degree of charge (I) in the blasting calculation;

determining, in advance, specific charge values (q) for the holes of different parts of the drilling pattern; and tabulating, in advance, the charges to be used in the different parts of the pattern.

4. A method as claimed in claim 1, comprising utilizing predetermined specific charge values (q), hole spacing (E) and average degree of charge (I) in accordance with formula $V=I/(q*E)$, wherein V is burden, in the blasting calculation.

5. A method as claimed in claim 1, comprising taking the blasting calculation into account when placing the locations of the drill hole bottoms at the bottom of the round.

6. A method as claimed in claim 1, comprising:

taking the blasting calculation into account when placing the locations of the drill hole bottoms at the bottom of the round, determining, in advance, ratio (F), which is the quotient of hole spacing (E) and burden (V), for placement of drill hole bottom locations;

determining a calculatory hole spacing (E) by formula $E=\sqrt{[(I*F)/q]}$, wherein q is specific charge value, I is average degree of charge;

determining, in the drilling pattern, a section wherein drill hole bottom location are placed;

dividing a length of the section to be processed by the calculatory hole spacing (E), yielding the exact number of drill holes to be placed in the section;

selecting the nearest integer to the exact number of drill holes to be placed in the section as the number of drill hole bottoms to be placed in the section, and calculating a new hole spacing (E1) in such a manner that the locations of the drill hole bottoms are at equal distances; and calculating burden (V) by formula $V=E1/F$.

7. A method as claimed in claim 1, comprising placing drill hole bottom locations manually in at least one group of holes.

8. A method as claimed in claim 1, comprising:

determining the hole spacing (E) between the drill hole bottoms in at least one group of holes in advance; and placing drill hole bottom locations in a group of holes automatically by means of the drilling pattern design program taking into account the predetermined hole spacing (E).

9. A method as claimed in claim 1, comprising:

determining the hole spacing between the drill hole bottoms in at least one group of holes in advance;

marking off manually a desired section of a group of holes; and placing drill hole bottom location in a predetermined section automatically by means of the drilling pattern design program in accordance with the predetermined hole spacing.

10. A method as claimed in claim 1, comprising:

determining manually a desired part of a group of holes;

determining manually the number of drill holes in said part of the group of holes; and placing, automatically by means of the drilling pattern design program, the selected number of drill hole bottom location at equal intervals in the determined part of the group of holes.

11. A method as claimed in claim 1, comprising:

giving a direction for a drill hole; and determining a starting location for the drill hole at the navigation plane on the basis of the drill hole bottom location and the drill hole direction.

12. A method as claimed claim 1, comprising:

giving a starting location for a drill hole on the navigation plane; and calculating a direction for the drill hole on the basis of the drill hole bottom and the given starting location.

13. A method as claimed in claim 1, comprising:

determining, for the rock cavern to be excavated, an end profile, which is a line passing through the drill hole bottoms of an outermost group of holes;

determining cracking zones at least for the drill holes of the end profile on the basis of charge information of each drill hole;

comparing a cracking zone of the drill holes of the end profile with a predetermined, allowed cracking zone at least at the bottom of the round; and indicating to a user if the cracking zone of even one drill hole is larger than the allowed cracking zone.

14. A method as claimed in claim 1, comprising:

determining, for the rock cavern to be excavated, an end profile, which is a line passing through the drill hole bottoms of an outermost group of holes;

determining cracking zones at least for the drill holes of the end profile on the basis of charge information of each drill hole;

comparing a cracking zone of the drill holes of the end profile with a predetermined, allowed cracking zone at least at the bottom of the round;

indicating to a user if the cracking zone of even one drill hole is larger than the allowed cracking zone;

displaying a profile of the predetermined, allowed cracking zone between the navigation plane and the blast plane in a graphic user interface;

displaying, in a graphic user interface, the cracking zone of each drill hole as a cracking circle generated around the drill hole bottoms and the starting locations in the end profile, the size of the diameter of the cracking zone being proportional to the size of the cracking zone;

generating a cylindrical cracking space between the cracking circle of each drill hole bottom and the cracking circle of the starting location; and indicating to the user if even one cylindrical cracking space intercepts the profile of the allowed cracking zone between the navigation plane and the blast plane.

15. A method as claimed in claim 1, comprising:

determining, for the rock cavern to be excavated, an end profile, which is a line passing through the drill hole bottoms of an outermost group of holes;

determining cracking zones at least for the drill holes of the end profile on the basis of charge information of each drill hole;

comparing a cracking zone of the drill holes of the end profile with a predetermined, allowed cracking zone at least at the bottom of the round;

indicating to a user if the cracking zone of even one drill hole is larger than the allowed cracking zone;

determining at least one aid row, which is a group of holes located inside the end profile and comprises a plurality of drill holes, through whose bottoms the aid row passes; and performing cracking zone examination additionally at least for the drill holes of an outermost aid row.

16. A method as claimed in claim 1, comprising:

utilizing mutual dependencies, stored in advance in a memory, between burden (V), hole spacing (E), specific charge (q) and degree of charge (I) and blasting-technical data, stored in advance in a memory, about the specific charge (q) and the degree of charge (I) in the blasting calculation;

determining, for the cavern to be excavated, an end profile, which is a line passing through the drill hole bottoms of an outermost group of holes;

determining, for the end profile at the blast plane, a plurality of drill hole bottom locations at a distance equal to a desired hole spacing (E) from each other;

determining burdens (V) for the drill holes of the end profile at the blast plane by means of blasting-technical calculation;

determining, at the blast plane, at least one first burden line inside the end profile at the ends of the burdens determined for the drill holes of the end profile;

placing a first aid row on one of the at least one first burden line of the end profile;

determining, at the blast plane, a plurality of drill hole bottom locations for the first aid row at a distance equal to the desired hole spacing (E) from each other; and displaying at least the end profile, one of the at least one first burden line and the drill holes bottom locations in a graphic user interface.

17. A method as claimed in claim 1, comprising:

utilizing mutual dependencies, stored in advance in a memory, between burden (V), hole spacing (E), specific charge (q) and degree of charge (I) and blasting-technical data, stored in advance in a memory, about the specific charge (q) and the degree of charge (I) in the blasting calculation;

determining, for the cavern to be excavated, an end profile which is a line passing through the drill hole bottoms of an outermost group of holes;

determining, for the end profile at the blast plane, a plurality of drill hole bottom locations at a distance equal to a desired hole spacing from each other;

determining burdens for the drill holes of the end profile at the blast plane by means of blasting-technical calculation;

determining, at the blast plane, at least one first burden line inside the end profile at the ends of the burdens determined for the drill holes of the end profile;

placing a first aid row on one of the at least one first burden line of the end profile;

determining, at the blast plane, a plurality of drill hole bottom locations for the first aid row at a distance equal to the desired hole spacing from each other;

displaying at least the end profile, one of the at least one first burden line and the drill holes bottom locations in a graphic user interface, and determining burdens (V) for the drill holes of the end profile by blasting-technical calculation, wherein at least predetermined specific charge values (q), hole spacing (B) and average degree of charge (I) are utilized in accordance with formula V=I/(q*E).

18. A method as claimed in claim 1, comprising:

utilizing mutual dependencies, stored in advance in a memory, between burden (V), hole spacing (E), specific charge (q) and degree of charge (I) and blasting-technical data, stored in advance in a memory about the specific charge (q) and the degree of charge (I) in the blasting calculation;

determining, for the cavern to be excavated, an end profile, which is a line passing through the drill hole bottoms of an outermost group of holes;

determining, for the end profile at the blast plane, a plurality of drill hole bottom locations at a distance equal to a desired hole spacing (E) from each other;

determining burdens (V) for the drill holes of the end profile at the blast plane by means of blasting-technical calculation;

determining, at the blast plane, at least one first burden line inside the end profile at the ends of the burdens determined for the drill holes of the end profile;

placing a first aid row on one of the at least one first burden line of the end profile;

determining, at the blast plane, a plurality of drill hole bottom locations for the first aid row at a distance equal to the desired hole spacing (E) from each other;

displaying at least the end profile, one of the at least one first burden line and the drill holes bottom locations in a graphic user interface;

generating a first circle of burden for each drill hole of the end profile around the drill hole bottom;

generating the circle of burden in such a manner that the size of the radius of the circle of burden is proportional to the size of the burden; and generating a first burden line that intercepts the circumference of each first circle of burden at one point in its inner edge.

19. A method as claimed in claim 1, comprising:

utilizing mutual dependencies, stored in advance in a memory, between burden (V), hole spacing (E), specific charge (q) and degree of charge (I) and blasting-technical data, stored in advance in a memory, about the specific charge (q) and the degree of charge (I) in the blasting calculation;

determining, for the cavern to be excavated, an end profile, which is a line passing through the drill hole bottoms of an outermost group of holes;

determining, for the end profile at the blast plane, a plurality of drill hole bottom locations at a distance equal to a desired hole spacing (E) from each other;

determining burdens (V) for the drill holes of the end profile at the blast plane by means of blasting-technical calculation;

determining, at the blast plane, at least one first burden line inside the end profile at the ends of the burdens determined for the drill holes of the end profile;

placing a first aid row on one of at least one first burden line of the end profile;

determining, at the blast plane, a plurality of drill hole bottom locations for the first aid row at a distance equal to the desired hole spacing (E) from each other;

displaying at least the end profile, one of the at least one first burden line and the drill holes bottom locations in a graphic user interface;

determining at least one second burden line around the drill holes on a first aid row on the basis of the blasting-technical calculation to be performed at the blast plane;

placing a second aid row on one of the at least one second burden line inside the previous aid row; and determining a plurality of drill hole bottom location at a distance equal to the desired hole spacing (E) from each other for the second aid row at the blast plane.

20. A method as claimed in claim 1, comprising:

utilizing mutual dependencies, stored in advance in a memory, between burden (V), hole spacing (E), specific charge (q) and degree of charge (I) and blasting-technical data, stored in advance in a memory, about the specific charge (q) and the degree of charge (I) in the blasting calculation;

determining, for the cavern to be excavated, an end profile, which is a line passing through the drill hole bottoms of an outermost group of holes;

determining, for the end profile at the blast plane, a plurality of drill hole bottom locations at a distance equal to a desired hole spacing (E) from each other;

determining burdens (V) for the drill holes of the end profile at the blast plane by means of blasting-technical calculation;

determining at the blast plane, at least one first burden line inside the end profile at the ends of the burdens determined for the drill holes of the end profile;

placing a first aid row on one of the at least one first burden line of the end profile;

determining, at the blast plane, a plurality of drill hole bottom locations for the first aid row at a distance equal to the desired hole spacing (E) from each other;

displaying at least the end profile, one of at least one first burden line and the drill holes bottom locations in a graphic user interface;

determining at least one third burden line by means of blasting-technical calculation for the drill holes of an innermost aid row;

placing a cut in the drilling pattern;

giving at least one field hole element to the drilling pattern design program;

generating field drill holes in an area outlined by one of at least one third burden line of the innermost aid row and the cut automatically in the drilling pattern design program;

determining circles of burden and a fourth burden line for a field hole element; and placing a following field hole element on the burden line of a previous element.

21. A method as claimed in claim 1, comprising:

determining at least one master hole in at least one group of holes in the drilling pattern;

determining at least one dominating property for the master hole;

determining a property of at least one second drill hole on the basis of the dominating property of the master hole; and using a master hole to be edited afterwards, which may be added or removed, and whose dominating properties are modifiable.

22. A method as claimed in claim 1, comprising:

determining, in at least one group of holes in the drilling pattern, at least two master holes between which at least one intermediate hole is located;

determining, for the master holes, at least one of the following dominating properties:

location in group of holes, depth, hole direction angle, degree of charge, hole spacing; and determining at least one property of an intermediate hole on the basis of the dominating properties of the master holes.

23. A method as claimed in claim 1, comprising:

determining, in at least one group of holes in the drilling pattern, at least two master holes between which at least one intermediate hole is located;

determining, for the master holes, at least one of the following dominating properties:

location in group of holes, depth, hole direction angle, degree of charge, hole spacing;

determining at least one property of an intermediate hole on the basis of the dominating properties of the master holes; and using, in the drilling pattern, master holes to be edited afterwards, which may be added and removed, and whose dominating properties are modifiable.

24. A non-transitory storage device including software product for designing a drilling pattern, the execution of the software product in a computer being adapted to:

determine, in the drilling pattern at a bottom of a round, a blast plane at a distance from a navigation plane equal to a length (L) of the pattern;

place drill hole bottom locations at the bottom of the round at the blast plane;

perform blasting calculation for at least some holes in the drilling pattern at the blast plane;

view the drill holes from the bottom of the round towards the navigation plane of the drilling pattern; and adapted to determine drill hole properties in response to a drill hole bottom location and at least one of the following given properties: starting location of drill hole at navigation plane, direction of drill hole.

25. A rock-drilling rig comprising:

a movable carrier;

at least one drilling boom;

at least one drilling unit in the drilling boom, the at least one drilling unit comprising a feeding beam and a rock-drilling machine adapted movable with the feeding beam by means of feeding means;

at least one control unit for controlling the rock-drilling rig, the at least one control unit comprising at least one computer, wherein a control unit is also arranged to execute and includes a software product for designing a drilling pattern, the execution of the software product interactively with a user being adapted to:

determine, in the drilling pattern at a bottom of a round, a blast plane at a distance from a navigation plane equal to a length (L) of the pattern, place drill hole bottom locations at the bottom of the round at the blast plane, perform blasting calculation for at least some holes in the drilling pattern at the blast plane, view the drill holes from the bottom of the round towards the navigation plane, and determine drill hole properties in response to a drill hole bottom location and at least one of the following, given properties: starting location of drill hole at navigation plane, direction of drill hole.

* * * * *